US007366445B2

(12) United States Patent
Hoashi et al.

(10) Patent No.: US 7,366,445 B2
(45) Date of Patent: Apr. 29, 2008

(54) IMAGE FORMING APPARATUS INCLUDING A PLURALITY OF IMAGE BEARING MEMBERS HAVING A SPEED VARIATION SUPPRESSION FEATURE

(75) Inventors: Shigeru Hoashi, Numazu (JP); Kazuo Chadani, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 104 days.

(21) Appl. No.: 11/301,253

(22) Filed: Dec. 13, 2005

(65) Prior Publication Data

US 2006/0146371 A1 Jul. 6, 2006

(30) Foreign Application Priority Data

Dec. 13, 2004 (JP) ..... 2004-360143
Dec. 1, 2005 (JP) ..... 2005-348086

(51) Int. Cl.
*G03G 15/00* (2006.01)

(52) U.S. Cl. ..... 399/167

(58) Field of Classification Search ..... 399/116, 399/117, 167, 299, 301
See application file for complete search history.

(56) References Cited

U.S. PATENT DOCUMENTS 6,385,418 B1 * 5/2002 Fukuchi ..... 399/167
6,483,527 B2 11/2002 Kaneko et al. ..... 347/138
6,684,041 B2 * 1/2004 Yokomori et al. ..... 399/167
6,876,821 B2 4/2005 Ishii ..... 349/49
7,121,205 B2 * 10/2006 Ono et al. ..... 399/167 X
2005/0025523 A1 2/2005 Iwasaki et al. ..... 399/167

FOREIGN PATENT DOCUMENTS

JP 2001-242671 9/2001
JP 2002-189324 7/2002
JP 2003-177588 6/2003
JP 2005-62806 3/2005

* cited by examiner

*Primary Examiner*—Sandra L. Brase
(74) *Attorney, Agent, or Firm*—Fitzpatrick, Cella, Harper & Scinto

(57) ABSTRACT

An image forming apparatus includes an image bearing member, wherein a toner image is formed on the image bearing member and is transferred onto a recording material, thus forming an image on the recording material; a shaft for rotating the image bearing member, wherein the shaft is provided with a first projection and a second projection, and the image bearing member is provided with a first engaging portion and a second engaging portion which are engageable with the first projection and the second projection, respectively, and wherein the first engaging portion is abuttable to the first projection at downstream and upstream sides of the first projection with respect to a rotational direction of the shaft, and the second engaging portion is abuttable to the second projection at a downstream side of the second projection, and wherein a gap is provided between the second engaging portion and the second projection at an upstream side of the second projection.

25 Claims, 18 Drawing Sheets

IMAGE FORMING APPARATUS INCLUDING A PLURALITY OF IMAGE BEARING MEMBERS HAVING A SPEED VARIATION SUPPRESSION FEATURE

FIELD OF THE INVENTION AND RELATED ART

The present invention relates to an image forming apparatus, for example, a copying machine, a printer, or a facsimile machine, having a function of forming an image on recording medium in the form of a sheet or the like. In particular, it relates to the driving of an image bearing member with which an image forming apparatus is provided.

In recent years, demand has been increasing for an electrophotographic image forming apparatus capable of forming a color (multicolor) image; there has been a strong desire for a color image forming apparatus capable of satisfying the following six requirements: (1) being low in operational cost, (2) small in size, (3) low in power consumption, (4) high in image quality, (5) high in operational speed, and better in operability.

There are some technologies for providing an image forming apparatus which satisfies some the abovementioned requirements. One of such technologies improves an image forming apparatus in operability and increases in speed, by forming an image with the use of four photosensitive drums. More specifically, a color image forming apparatus is provided with four process cartridges for forming yellow, magenta, cyan, and black images, one for one. The four process cartridges are disposed in the main assembly of the image forming apparatus so that the four photosensitive drums, which are in the four process cartridges, one for one, are disposed in parallel. A color image forming apparatus employing this image forming method is called color image forming apparatus of the tandem type, or four drum type.

One of the problems which an image forming apparatus of this type suffers is as follows. According to this image forming method, four monochromatic images which are different in color are independently formed, and then, are integrated into a single multicolor image. Therefore, it is possible that one or more of the four monochromatic images are formed at the ideal position or positions, color misregistration will result (for example, misregistration between black and cyan image.

For example, if the positional relationship between the four photosensitive drums and corresponding exposing apparatuses deteriorates, As the countermeasure for this problem, it is possible to minimize the deviation in the positional relationship between the four photosensitive drums and corresponding four exposing means by supporting all of the four photosensitive drums and four exposing means with the two lateral plates of the main assembly of an image forming apparatus so that the four photosensitive drums and corresponding exposing means are precisely positioned relative each other and maintained in their precise positions.

For example, a possible deterioration of the positional accuracy between the four photosensitive drums and respective exposure means occurs, the positions of the respective color images are deviated in the scanning direction, with respect to color misregistration when they are overlapped. There is a solving method wherein all of the four photosensitive drums and four exposure means are positioned by common side plates in the main assembly of the image forming apparatus to minimum the positional error between the units.

If the positional deviation occurs periodically due to variation in the rotation of the photosensitive drum, the degree of the color misregistration would be approx. 2 times the positional deviation degree in a monochromatic image at the maximum depending on the deviation in the rotational phases of the photosensitive drums.

To avoid this, there is a method wherein a positional deviation detection pattern is formed on a sheet feeding means, and is read by detecting means, which then calculates the degree of the positional deviation; on the other hand, rotational phases of the driving gears for driving the photosensitive drums are detected by a photo-sensor or the like, and on the basis of the detection signal thereof and the positional deviation processing value, the rotational phase of the driving gear is controlled beforehand so as to provide ideal positional relations during the image forming operation.

However, in the photosensitive drum unit in the process cartridge, (1) a coupling member for receiving a driving force from the main assembly of the apparatus, (2) bearing members for high accuracy alignment with the both side plates of the main assembly of the apparatus, and (3) a flange member for supporting the photosensitive drum on the rotation shaft are fixed on the rotation shaft (providing the rotation center), independently from each other, but it is only the coupling member with which the rotational phase relation with the photosensitive drum driving gear which can be controlled in the phase in response to the detecting means of the main assembly of the apparatus, can be determined uniquely.

Therefore, there arises a deviation between a rotational phase of the flange member which supports and positions the photosensitive drum actually forming the images and a rotational phase of the photosensitive drum driving gear of the main assembly side of the apparatus, with the result that all of the rotational phases of the photosensitive drum are not aligned with the ideal positions.

In addition, the photosensitive drum driving gears, the coupling members and the flange members may involve individual differences in the part accuracies and part strengths due to the difference in the cavities (the difference resulting from difference in the cavities in the material during manufacturing) and due to the lot difference (the difference between lots of products). Furthermore, there are unit differences among different color parts resulting form combination of parts (difference resulting from differences among the manufactured units. These factors lead to the possible variations in the speeds of the photosensitive drums, which may result in the color misregistration in the image forming operation.

In this case, when the rotational phase of the flange member is uniquely determined in alignment with the rotational phase of the photosensitive drum driving gear, the rotational phases of the four color photosensitive drums can be aligned with each other, so that the color misregistration attributable to the phase difference can be avoided, and a relatively good color registration is accomplished. However, with such a structure, a force is produced tending to displace the photosensitive drum in a direction (radial direction) perpendicular to the shaft. In such a case, the rotational driving force is less efficient, and the photosensitive drum speed may vary.

As for the minimization of the color misregistration for the same reason, there is a method in which a positional deviation detection pattern is actually formed on the sheet feeding means, and the pattern is read by detecting means to detect the amount of positional deviation, on the basis of which the rotational phase deviation between the photosensitive drum actually forming the image and the photosensitive drum driving gear of the main assembly side of the apparatus is corrected. Such a method, however, the formation of the detection pattern and the phase correction responsive to the detection require long time, and therefore, the user has to wait for a relatively long time.

In addition, the phase adjustment accuracy in the positional deviation correction using a detection pattern formation is limited, and the phase difference is not completely removed after the correction in some cases. To solve such a problem, it would be considered to enhance the resolving power of the detection pattern, but if this is done, the time required for the pattern formation becomes longer correspondingly, with the possible result of increased stress imparted to the user.

Even if the rotational phases of the respective colors are correctly aligned with each other by the positional deviation correction using the detection pattern formation, the color misregistrations resulting from the parts differences attributable to the speed variation in the photosensitive drums due to the cavity difference, the lot difference and/or the unit difference.

SUMMARY OF THE INVENTION

Accordingly, it is a principal object of the present invention to provide an image forming apparatus with which the speed variations in the image bearing members are suppressed to reduce the deviation among the images.

It is an object of the present invention to provide an image forming apparatus comprising: an image bearing member, wherein a toner image is formed on said image bearing member and is transferred onto a recording material, thus forming an image on the recording material; a shaft for rotating said image bearing member, wherein said shaft is provided with a first projection and a second projection, and said image bearing member is provided with a first engaging portion and a second engaging portion which are engageable with said first projection and said second projection, respectively, and wherein said first engaging portion is abuttable to said first projection at downstream and upstream sides of said first projection with respect to a rotational direction of said shaft, and said second engaging portion is abuttable to said second projection at a downstream side of said second projection, and wherein a gap is provided between said second engaging portion and said second projection at an upstream side of said second projection.

It is another object of the present invention to provide an image carrying unit comprising an image bearing member; a shaft for rotating said image bearing member, wherein said shaft is provided with a first projection and a second projection, and said image bearing member is provided with a first engaging portion and a second engaging portion which are engageable with said first projection and said second projection, respectively, and wherein said first engaging portion is abuttable to said first projection at downstream and upstream sides of said first projection with respect to a rotational direction of said shaft, and said second engaging portion is abuttable to said second projection at a downstream side of said second projection, and wherein a gap is provided between said second engaging portion and said second projection at an upstream side of said second projection.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail, with reference to the appended drawings. The preferred embodiments of the present invention, which will be described hereafter, are not intended for limiting the scope of the present invention. In other words, the measurements, materials, and shapes of the structural components, and the positional relationship among the structural components, in the following embodiments of the present invention, should be adjusted as necessary in accordance with the structure of an apparatus to which the present invention is applied, and the various conditions under which an apparatus to which the present invention is applied is operated.

(General Description of Image Forming Apparatus)

Figure 1:
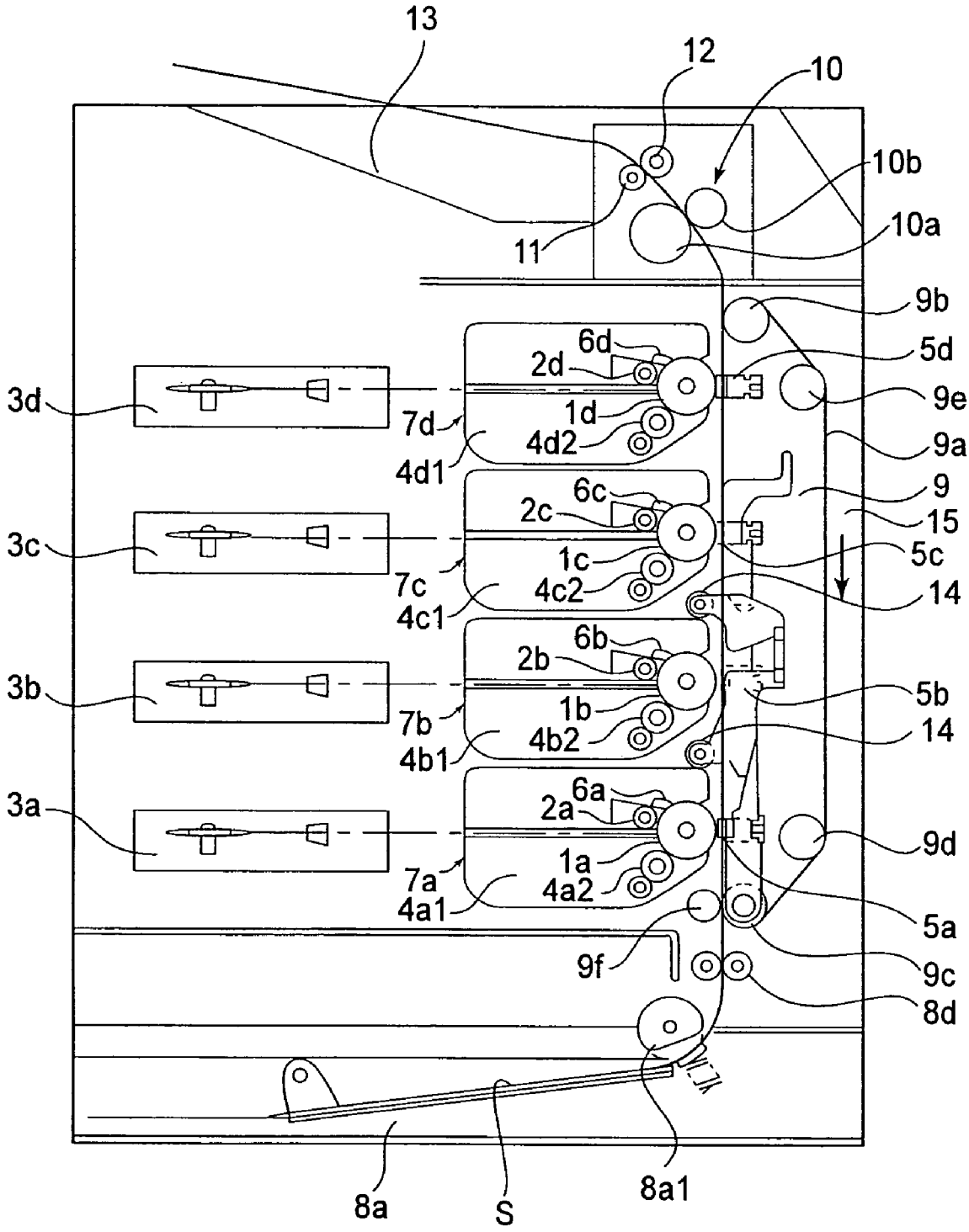
FIG. 1 is a drawing showing the image forming apparatus in one of the preferred embodiment of the present invention.

FIG. 1 is a sectional view of a color image forming apparatus in the preferred embodiments of the present invention, showing the general structure thereof.

The color image forming apparatus is provided with four photosensitive drums 1*a*, 1*b*, 1*c*, and 1*d* as image bearing members. In the adjacencies of the peripheral surfaces of photosensitive drums 1*a*, 1*b*, 1*c*, and 1*d*, charging device 2*a*, 2*b*, 2*c*, 2*d* for uniformly charge the peripheral surfaces of the photosensitive drums 1*a*, 1*b*, 1*c*, and 1*d*, exposing devices 3*a*, 3*b*, 3*c*, and 3*d* for forming an electrostatic latent image on the peripheral surfaces of the photosensitive drums 1*a*, 1*b*, 1*c*, and 1*d* by projecting a beam of laser light on the peripheral surfaces of the photosensitive drums 1*a*, 1*b*, 1*c*, and while modulating it which image formation data, developing apparatuses (which are made up of toner storage portions 4*a*1, 4*b*1, 4*c*3, and 4*d*4, development rollers 4*a*2, 4*b*2, 4*b*2, and 4*d*2, etc.) for adhering toner to the peripheral surfaces of the photosensitive drums 1*a*, 1*b*, 1*c*, and 1*d*, in the pattern of the electrostatic latent image, in order to develop the electrostatic latent image into an image formed of toner, that is, a visible image, transferring devices (transferring member) 5*a*, 5*b*, 5*c*, and 5*d* for transferring the toner images on photosensitive drums 1*a*, 1*b*, 1*c*, and 1*d*, onto a sheet S of recording medium, cleaning devices 6*a*, 6*b*, 6*c*, and 6*d* for removing the transfer residual toner, that is, the toner remaining on the peripheral surfaces of the photosensitive drums 1*a*, 1*b*, 1*c*, and 1*d* after the transfer of the toner images therefrom, etc., are disposed, respectively. These devices make up an image forming device (image formation portion).

The photosensitive drums 1*a*, 1*b*, 1*c*, and 1*d*, charging devices 2*a*, 2*b*, 2*c*, and 2*d*, developing devices 4*a*, 4*b*, 4*c*, and 4*d*, and cleaning devices 6*a*, 6*b*, 6*c*, and 6*d*, are integrally placed in four cartridges, one for one, making up four process cartridges 7*a*, 7*b*, 7*c*, and 7*d*.

As for the operation of this image forming apparatus, a sheet S fed into the main assembly of the image forming apparatus from a sheet feeding portion (which will be described later) is conveyed through the image forming devices by a conveying device 9 made up of a conveyer belt, etc. While the sheet S is conveyed through the image forming devices, four monochromatic toner images different in color are sequentially transferred onto the sheet S, forming an unfixed full-color image composed of the four monochromatic toner images different in color, on the sheet S. Then, the unfixed full-color image is fixed to the sheet S by a fixing device 10 (fixing portion). Then, the sheet S to which the full-color image has been fixed is discharged into a delivery tray 13 by a pair of sheet discharge rollers 11 and 12.

When the image forming apparatus is in the two-sided printing mode, the discharge rollers 11 and 12 are reversed in rotation before they completely discharge the sheet S, to which the multi-color image has been fixed, into the delivery tray 13. As a result, the sheet S is conveyed in the direction indicated by an arrow mark, into a two-sided printing path 15. In the two-side printing path 15, the sheet P is moved past a roller located behind the front panel to convey the sheet P in the diagonally downward, and then, is conveyed vertically downward to a U-turn roller. Then, the sheet S is conveyed back to the image formation portion by the U-turn roller and a pair of registration roller 8*d*.

Next, each of the essential portions of the image forming apparatus will be described. one by one.

(Sheet Conveying Portion)

The sheet conveying portion is made up of a sheet feeder cassette 8*a*, a pickup roller 8*a*1, the pair of registration rollers 8*d*, etc.

The sheet feeder cassette 8*a* holds multiple sheets S of recording medium, and is placed in the bottom portion of the image forming apparatus main assembly. If an image forming operation is set up so that the sheet P is to be fed from the sheet feeder cassette 8*a*, the sheets S are fed into the main assembly, by the pickup roller 8*a*1, while being separated one by one, and then, are delivered to the image formation portions by the registration rollers 8*d*, etc.

The force for separating the sheets S as they are fed out of the sheet feeder cassette 8*a*, and the force for further conveyance of the sheets S, are transmitted from an unshown sheet conveyance motor of the sheet conveying portion, through a gear train.

(Image Forming stations)

Each of the photosensitive drums 1*a*, 1*b*, 1*c*, and 1*d* as the image bearing members, is made up of an aluminum cylinder, and a layer of organic photoconductor (OPC) coated on the peripheral surface of the aluminum cylinder. Each photosensitive drum is rotatably supported at its lengthwise end portions. More specifically, the photosensitive drum is rotatably supported at the pair of flange 60 (FIG. 4) attached to the lengthwise ends of the photosensitive drum. As driving force is transmitted to one of the lengthwise ends of the photosensitive drum, the photosensitive drum is rotated in the counterclockwise direction indicated by an arrow mark in FIG. 1.

Each of the charging devices 2*a*, 2*b*, 2*c*, and 2*d* is provided with an electrically conductive member in the form of a roller, which is kept in contact with the peripheral surface of the corresponding photosensitive drum. As voltage as charge bias is applied to the charge device from an unshown electrical power source, the peripheral surface of the corresponding photosensitive drum is uniformly charged.

Each of the exposing devices 3*a*, 3*b*, 3*c*, and 3*d* is provided with a polygon mirror, onto which a beam of laser light is projected from a laser diode (unshown) while being modulated with video signals.

The four developing devices are made up of: toner storage portions 4*a*1, 4*b*1, 4*c*1, and 4*d*1 which store yellow, cyan, magenta, and black toners, respectively; development rollers 4*a*2, 4*b*2, 4*c*2 and 4*d*2, which are disposed so that their peripheral surfaces are placed almost in contact with the peripheral surfaces of the corresponding photosensitive drums; etc. As voltage as development bias is applied to each development roller from an unshown development bias power source, an electrostatic latent image on the corresponding photosensitive drum is developed.

On the inward side of the loop which a transfer belt 9*a* (which will be described later) forms, the transferring members 5*a*, 5*b*, 5*c*, and 5*d* are disposed in contact with the transfer belt 9*a*, opposing the four photosensitive drums 1*a*, 1*b*, 1*c*, and 1*d*, respectively. The transferring members 5*a*, 5*b*, 5*d*, and 5*d* are connected to an unshown transfer bias power source, from which positive electrical charge is given, through the transferring member, to the sheet S, which is in contact with the peripheral surface of the photosensitive drum. As a result, the toner images, different in color, on the photosensitive drums 1*a*, 1*b*, 1*c*, and 1*d*, one for one, are sequentially transferred onto the sheet S, by the electric fields generated by the positive electrical charge, since the toner images on the photosensitive drums are negative in polarity. Consequently, a single multicolor image is composed on the sheet S.

(Structure of Sheet Conveyance Mechanism)

The sheet S is conveyed by the sheet conveying device 9 from the sheet feeding portion to the image forming area.

The sheet conveying device 9 is made up of a sheet conveyance belt 9*a* as an sheet bearing member, and four rollers, that is, a single driver roller 9*b* and three follower rollers 9*c*, 9*d*, and 9*e*, around which the sheet conveyance belt 9*a* is stretched, being thereby supported, in contact with all of the photosensitive drums 1*a*, 1*b*, 1*c*, and 1*d*.

The transfer sheet conveyer belt 9*a* is circularly moved by the driver roller 9*b*, while electrostatically holding the sheet P on its outwardly facing surface which faces the photosensitive drums 1*a*, 1*b*, 1*c*, and 1*d*. Thus, the sheet S is conveyed by the transfer sheet conveyer belt 9*a* to the transfer points, at which the toner images on the photosensitive drums 1*a*, 1*b*, 1*c*, and 1*d* are transferred onto the sheet S.

At the location which coincides with the most upstream point of the moving range of the transfer sheet conveyer belt 9*a*, an adhesion roller 9*f* is disposed, which sandwiches the sheet S against the transfer sheet conveyer belt 9*a* and adheres the sheet S to the transfer sheet conveyer belt 9*a*. When the sheet S is conveyed, an electric field is generated between the adhesion roller 9*f*, and the aforementioned follower roller 9*c* (which is grounded), by applying voltage to the adhesion roller 9*f*, so that dielectric polarization is induced between the sheet conveyance belt 9*a* and sheet S to generate such electrostatic force that causes the sheet conveyance belt 9*a* and sheet S to attract each other.

(Auxiliary Structure for Sheet Conveyance)

In order to prevent the sheet S from peeling away from the sheet conveyance belt 9*a*, the sheet conveyance mechanism is provided with an auxiliary member for assisting the sheet conveyance mechanism while the sheet S is conveyed by the sheet conveyance belt 9*a*. The auxiliary sheet conveying member is located on the sheet bearing side of the sheet conveyance belt 9*a*. It also functions a device for moving the sheet conveyance belt 9*a* to a second position, in which the sheet conveyance belt 9*a* is kept separated from the photosensitive drums.

More specifically, multiple (two in this embodiment) rollers 14 as auxiliary sheet conveyance rollers, which are rotatable by the movement of the transfer sheet conveyer belt 9*a*, are disposed on the sheet bearing side of the transfer sheet conveyer belt 9*a*, in contact with the sheet bearing surface of the transfer sheet conveyer belt 9*a*. These auxiliary rollers 14 are movable together in the left to right, or right to left, direction of the drawing, by an unshown cam-based mechanism.

In the color recording mode, the auxiliary sheet conveyance rollers 14 remain retracted leftward to be kept away from the transfer sheet conveyer belt 9*a*, whereas in the monochromatic printing mode, they are moved rightward by the cam-based mechanism so that they are placed in contact with the transfer sheet conveyer belt 9*a*, and push the transfer sheet conveyer belt 9*a* rightward. As a result, the transfer sheet conveyer belt 9*a* is separated from the photosensitive drums 1*a*, 1*b*, and 1*c*, while remaining in contact with the photosensitive drum 1*d*.

(Fixing Portion)

Fixing portion 10 is a portion for fixing the unfixed toner image(s) on the sheet S by applying heat and pressure to the unfixed toner image(s).

Designated by a referential symbol 10*a* is an endless fixation belt having a layer in which heat can be generated electromagnetic induction. The fixation belt 10*a* is guided by a belt guide in the hollow of which a magnetic field generating device is disposed. The magnetic field generating device is made up of an excitation coil, and a magnetic core which is T-shaped in cross section.

Designated by a referential symbol 10*b* is an elastic pressure roller, which is kept pressed against the belt guide, with the application of a preset amount of pressure, forming a fixation nip having a preset width, with the fixing belt sandwiched between the elastic pressure roller 10*b* and belt guide.

The pressure roller 10*b* is rotationally driven by an unshown driving device. As the pressure roller 10*b* is rotationally driven, the fixation belt 10*a* is rotated by the rotation of the pressure roller 10*b*. As electric power is supplied to the excitation coil from an unshown excitation circuit, the fixation belt 10*a* is heated by electromagnetic induction.

With the temperature of the fixation nip having been started up to a preset level and being kept at the preset level, the sheet S, on which an unfixed toner image has been formed, is conveyed to the fixation nip, and is introduced into the fixation nip, with the image bearing surface of the sheet S facing downward, that is, with the image facing surface of the sheet S facing the fixation belt. Then, the sheet S is moved along with the fixation belt 10*a*, through the fixation nip, while remaining pinched between the fixation belt 10*a* and pressure roller 10*b*, with the image bearing surface of the sheet S kept in contact with the outwardly facing surface of the fixation belt 10.

While the sheet S is moved along with the fixation belt 10*a*, through the fixation nip, remaining pinched by the pressure roller 10*b* and fixation belt 10*a*, the fixation belt 10*a* is heated by electromagnetic induction, thermally fixing thereby the unfixed toner image on the sheet S to the sheet S.

(Image Forming Operation)

Next, the image forming operation of the image forming apparatus structured as described above will be described.

First, when the image forming apparatus is in the mode for recording a color image, the auxiliary sheet conveyance rollers 14 are kept retracted leftward, as shown in FIG. 1. When the auxiliary sheet conveyance rollers 14 are in the above described condition, the sheet conveyance belt 9*a* is in contact with the photosensitive drums 1*a*, 1*b*, 1*c*, and 1*d* (belt 9*a* is in first position). While the sheet S having been fed into the image forming apparatus main assembly is conveyed by the sheet conveyance belt 9*a*, remaining adhered thereto, through the image forming devices, toner images different in color are sequentially transferred onto the sheet S, composing thereby a single multicolor image on the sheet S. Thereafter, the multicolor image is fixed to the sheet S by the fixing device 10. Then, the sheet S is discharged in the delivery tray 13.

Next, the monochromatic printing operation (which in this embodiment is operation for printing in black color) will be described.

As the monochromatic printing mode which uses only the photosensitive drum 1, that is, the photosensitive drum for forming a black toner image, the unshown cam-based mechanism is driven to move the auxiliary sheet conveyance rollers 14 rightward. As a result, the transfer sheet conveyer belt 9*a* is pushed rightward by the auxiliary sheet conveyance rollers 14, being thereby separated from the photosensitive drums 1*a*, 1*b*, and 1*c*, that is, except for the photosensitive drum 1*d*, or the photosensitive drum for black image formation (second position).

A black toner image formed, with the auxiliary sheet conveyance rollers 14 kept in the above described condition, is transferred onto the sheet S. Then, the sheet S is discharged into the delivery tray 13, after the black toner image is fixed to the sheet S in the fixing device 10.

Next, the portions of the structure of the image forming apparatus in this embodiment, which characterize the image forming apparatus, will be described with reference to FIGS. 2-11.

Figure 2:
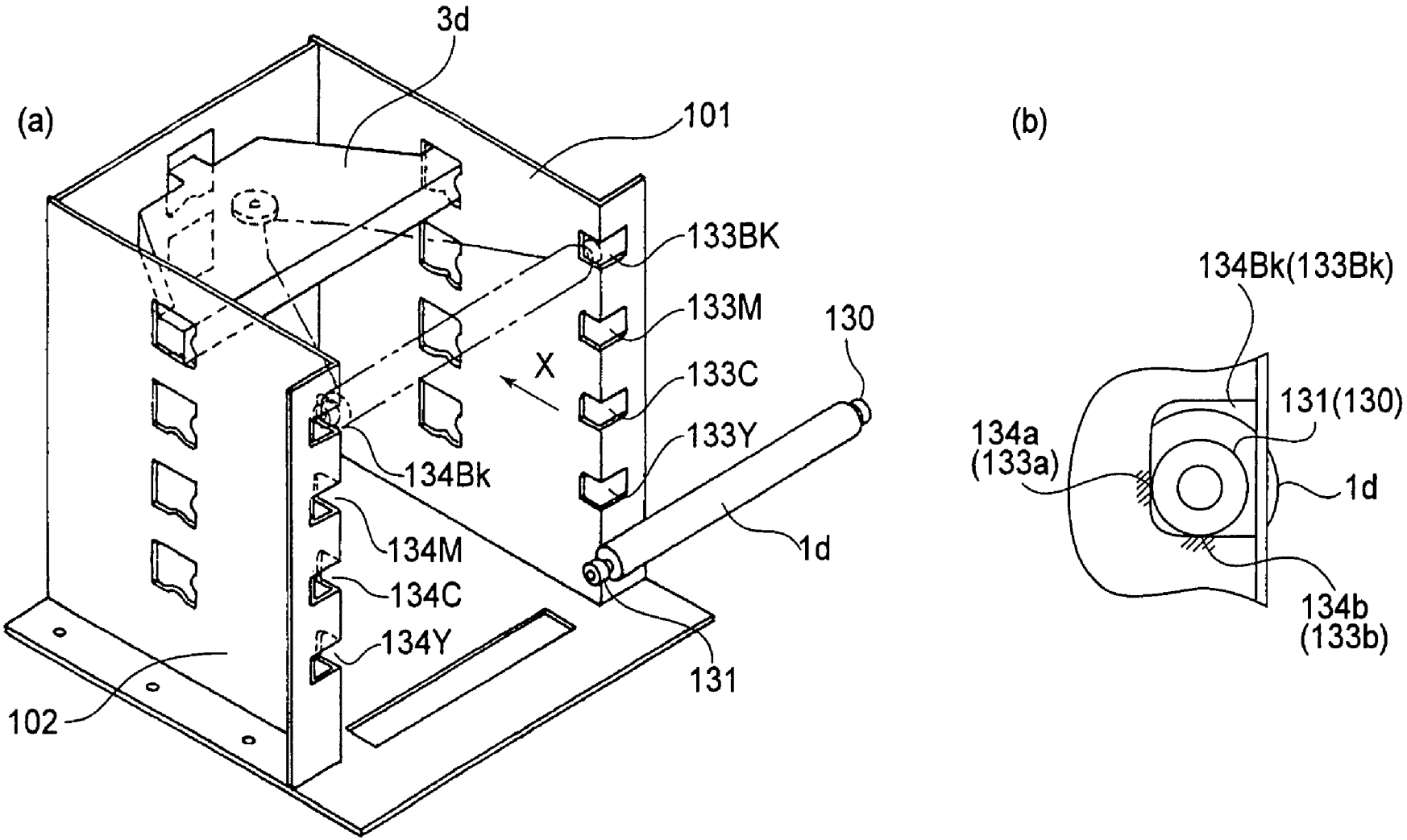
FIG. 2 is a drawing showing the positioning of the image bearing member in the main assembly of the image forming apparatus.

FIG. 2(*a*) is a drawing showing the sequence through which the process cartridge 7*d* is precisely positioned relative to the lateral plates of the image forming apparatus main assembly when the process cartridge 7*d* is mounted into the main assembly, and FIG. 2(*b*) is a drawing showing the portions, in FIG. 2(*a*), which are essential for the positioning of the photosensitive drum 7*d*. Although only the photosensitive drum 1*d* are shown in FIGS. 2(*a*) and 2(*b*), the positioning of the photosensitive drums 1*a*, 1*b*, and 1*d* is the same as that of the photosensitive drum 1*d*. Therefore, only the positioning of the photosensitive drum 1*d* will be described.

The photosensitive drum 7*d* is made up of the photosensitive drum 1*d*, processing means (charging device and developing device) which process the photosensitive drum 1*d*, and a cartridge in which the preceding components are integrally disposed. It can be mounted into, or removed from, the image forming apparatus main assembly by a user himself. In the main assembly of the image forming apparatus, a guide rail portion (unshown) is extended in the direction parallel to the direction in which the process cartridge 7*d* is mounted or removed. A user is to insert the process cartridge 7*d* along the guide rail portions. As the process cartridge 7*d* is inserted into the image forming apparatus main assembly, the bearing portions 130 and 131, which rotatably support the photosensitive drum 1*d* in the process cartridge 7*d*, come into contact, by their peripheral surfaces, with the bottom surfaces 133*a* and 134*a* of the corner slots 133Bk and 134Bk of the right and left lateral plates 101 and 102, respectively, of the main assembly (FIG. 2(*b*) shows only corner slot 134Bk, but, corner slot 133Bk is similar to corner slot 134Bk). As a result, the photosensitive drum 1*k* and process cartridge 7*d* are precisely positioned relative to the image forming apparatus main assembly, and are maintained in their precise portions relative to the main assembly.

Incidentally, designated by referential symbols 133Y and 134Y, referential symbols 133*c* and 134C, and referential symbols 133M and 134M, are the corner slots of the left and right lateral plates of the main assembly, which precisely position the photosensitive drums 1*a*, 1*b*, and 1*c* which correspond to yellow, cyan, and magenta colors, respectively.

To the outward surface of the right frame 101 (right lateral plate of main assembly) of the image forming apparatus main assembly, as seen from the trailing side of the process cartridges in terms of the direction in which the process cartridges are inserted into the main assembly, multiple photosensitive driving units 103Y, 103C, 103M, and 103Bk are fastened, being thereby precisely positioned relative to the frame 101.

Figure 3:
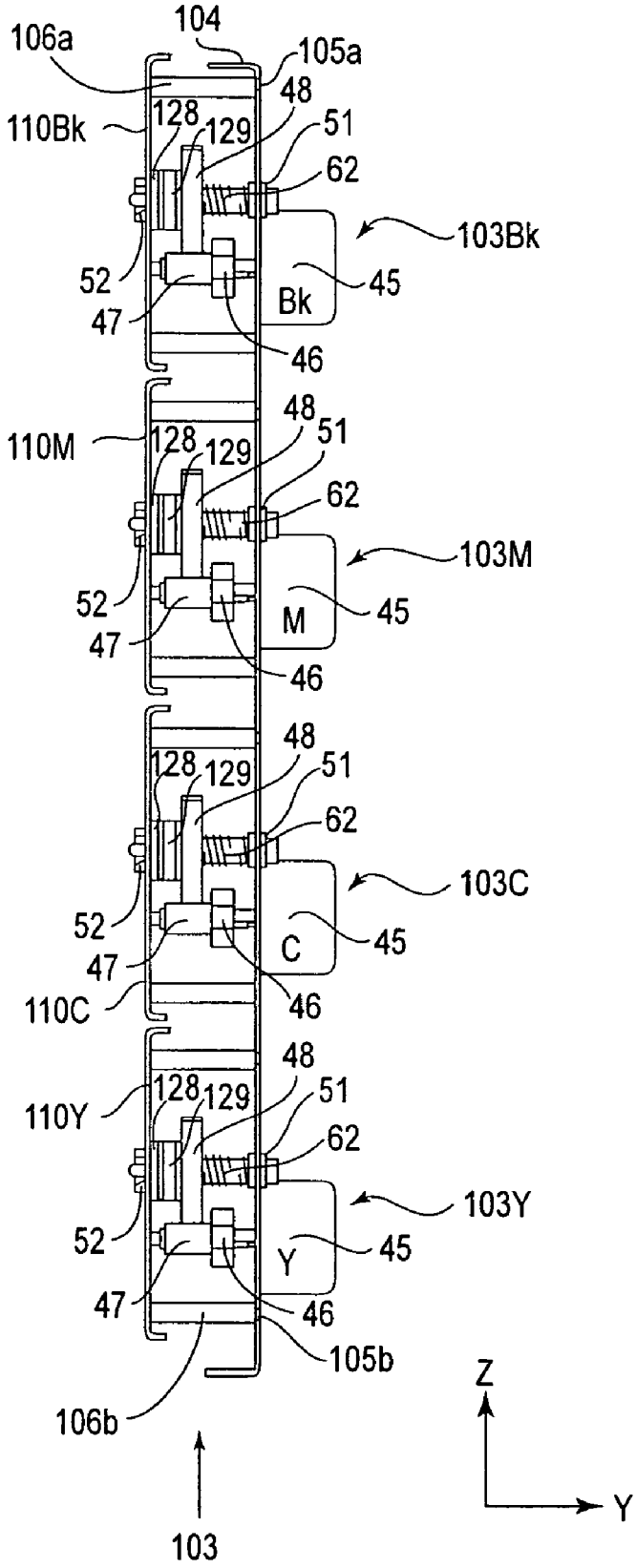
FIG. 3 is a drawing showing the driving unit for driving the image bearing member.

FIG. 3 is a drawing showing the driving units 103Y, 103C, 103M, and 103Bk.

The driving unit is made up of a driving unit frame 104, and driving portions 103 (103Y, 103C, 103M, and 103Bk) for driving the photosensitive drums 1*a*, 1*b*, 1*c*, and 1*d* (which correspond to yellow, cyan, magenta, and black colors, respectively), which are fastened to the driving unit frame 104, being thereby precisely positioned relative to the driving unit frame 104. Each driving portion 103 is made up of a drum motor 45 as a driving force source fastened to the driving unit frame 104, a pinion gear 46 fastened to the output shaft of the motor 45, a drum driving gear 48, an intermediary gear 47 meshed with the pinion gear 46 and drum driving gear 48 and rotatably supported, a bearing for supporting the drum driving gear 48, and a coupling 52 as a second coupling. The coupling 52 is a part of the drum driving gear 48. More specifically, the drum driving gear 48 is provided with a coupling portion, which projects inward of the image forming apparatus main assembly, and which has a recess as the coupling 52, which is triangular in cross section. The motor 45 is controlled by a controlling means with which the main assembly is provided. Incidentally, the second coupling 52 is a second driving force transmitting member for transmitting driving force to the axle of 64 of the photosensitive drum.

Further, the driving unit frame 104 is provided with two positioning holes 105*a* and 105*b* for positioning pins, the positions of which coincide with the straight line (x=0) connecting the axial lines of the photosensitive drums 1*a*, 1*b*, 1*c*, and 1*d*. The positioning pin hole 105*a* (first referential hole), that is, the positioning pin hole on the black image forming device side, serves as a referential point in terms of the z direction of the driving unit frame 104 (z=0). The driving portion 103 is fastened to right lateral plate 101 of the main assembly, with the use of small screws or the like, with reference to this positioning pin hole 105 a (first referential hole).

Further, the right lateral plate 101 of the image forming apparatus main assembly is provided with positioning pins 106*a* and 106*b*, which fit into the positioning pin holes 105*a* and 105*b* of the driving portion 103. The first positioning pin 106*a* precisely positions the driving portion 103, in terms of the x and y directions, by precisely fitting into the first positioning hole 105*a*. However, the second positioning hole 105*b*, into which the second positioning pin 106*b* is inserted, is an elongated hole, the long axis of which is parallel to the z direction. Therefore, as the second positioning pin 106*b* is inserted into the second positioning hole 105*b*, the driving portion 103 is fixed in position only in terms of the x and y directions. Here, the y direction is the direction parallel to the axial line of the photosensitive drum 1*d*. Thus, the horizontal direction is the xy direction, and the direction perpendicular to the axial line of the photosensitive drum 1*d* is the xz direction. The x direction is the direction parallel to the direction indicated by an arrow mark in FIG. 2(*a*).

Designated by referential symbols 110Y, 110C, 110M, and 110Bk are driving portion supporting members for supporting the positioning pins, coupling portions (having coupling recess), and motor shafts, of the driving portions 103*a*, 103*b*, 103*c*, and 103*d*, respectively.

Figure 4:
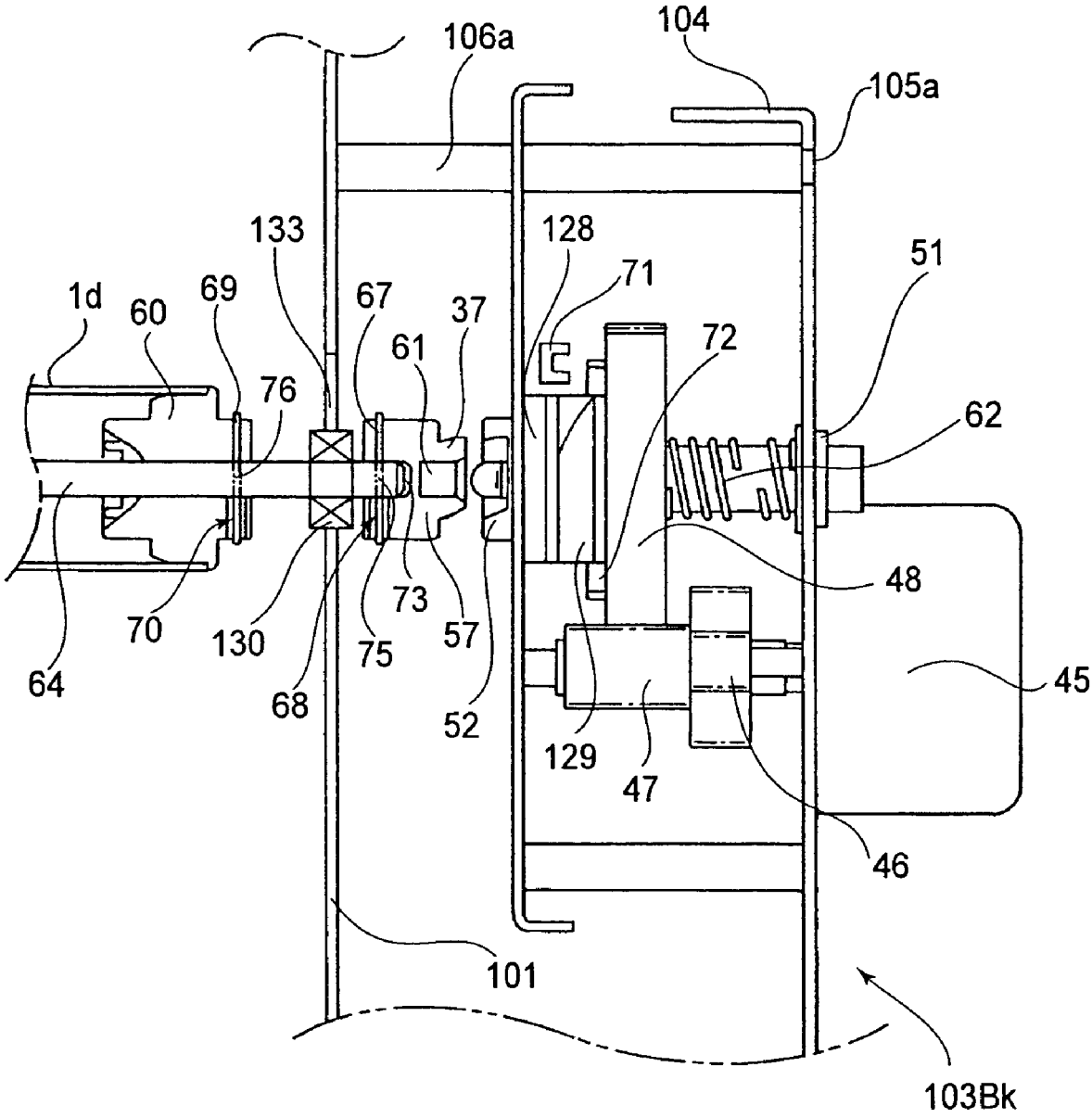
FIG. 4 is a drawing showing the state of connection between the driving unit and image bearing member.
Figure 5:
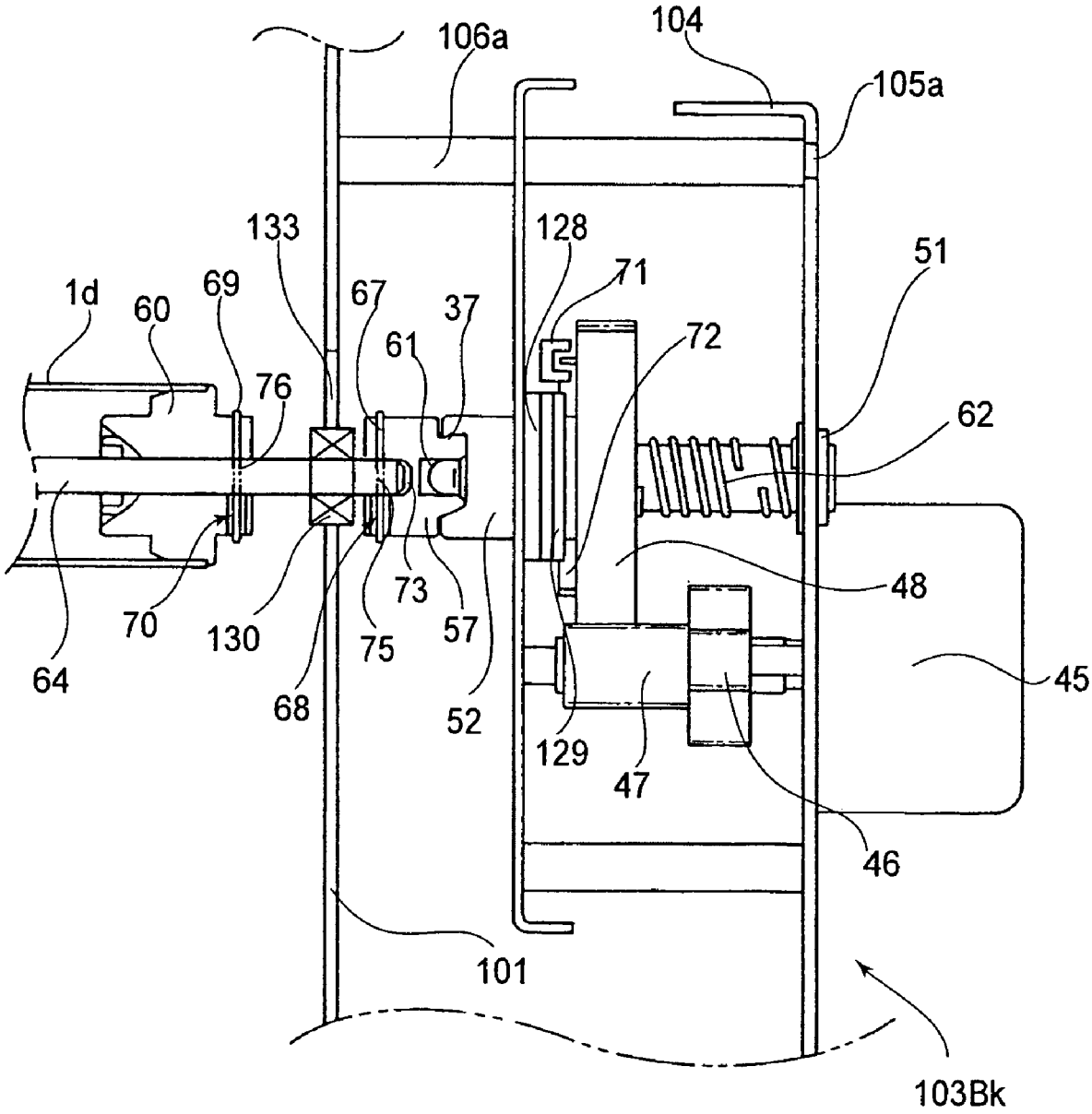
FIG. 5 is also a drawing showing the state of connection between the driving unit and image bearing member.

Next, referring to FIGS. 4 and 5, the structural arrangement for the connection or disconnection between the photosensitive drums 1*a*, 1*b*, 1*c*, and 1*d*, and driving portions 103Y, 103C, 103M, and 103Bk, respectively, will be described. FIGS. 4 and 5 are schematic drawings showing the state of connection between the photosensitive drum 1*d* and driving portion 103Bk. Figure shows the photosensitive drum 1*d* and driving portion 103Bk, which are not in connection with each other, whereas FIG. 5 shows the photosensitive drum 1*a* and 103Bk, which are in connection with each other.

After the mounting of the process cartridges in to the image forming apparatus main assembly by a user, a rotatable cam 128 is rotated in interrelation with the rotational movement for placing the transfer sheet conveyer belt 9*a* into contact with the photosensitive drums. As a result, the rotatable cam 129, or the counterpart of the rotatable cam 128, is thrust, along with the drum driving gear 48, toward the axle of the photosensitive drum by the resiliency of a return spring 62. As the rotatable cam 129 is thrust toward the axle of the photosensitive drum, a projection 37, as a coupling portion of a coupling 57, or the coupling on the drum side, as a first coupling member, attached to one of the lengthwise ends of the drum axle and being triangular in cross section, is moved into the aforementioned coupling recess 52 located in the end surface of the drum driving gear 48, connecting thereby the drum axle 64 to the drum driving gear 48. With this engagement between the coupling 57 and coupling 52, not only is the drum driving gear 48 accurately positioned relative to the photosensitive drum and locked with the drum axle 64, but also, the axial line of the drum driving gear 48 is aligned with the axial line of the photosensitive drum. Incidentally, the first coupling member 57 is a first transmitting member for transmitting driving force to the drum axle 64.

The coupling 52 has a twisted hole, the cross-section of which is in the form of an equilateral triangle, and into or from which the projection 37 of the coupling 57 is fitted or pulled out. As the projection 37 of the coupling 57 is fitted into the recess of the coupling 52, the ridges of the twisted projection with the equilaterally triangular cross-section come into contact with the surfaces of the recess with the equilaterally triangular cross-section. As a result, the coupling 57 (projection 37) and coupling 52 (recess) are connected so that their rotational axes coincide with each other.

Further, the bottom surface of the coupling recess of the coupling 52 comes into contact with the end surface of the coupling projection 37 of the coupling 57, positioning the drum driving gear 48 in terms of the direction in which the drum driving gear 48 is thrust leftward; the drum driving gear 48 is moved toward the process cartridge 7 as far as possible, and is kept in the farthest position, while being allowed to move rightward, being guided by the bearing 51, against the resiliency of the return spring 62.

Figure 6:
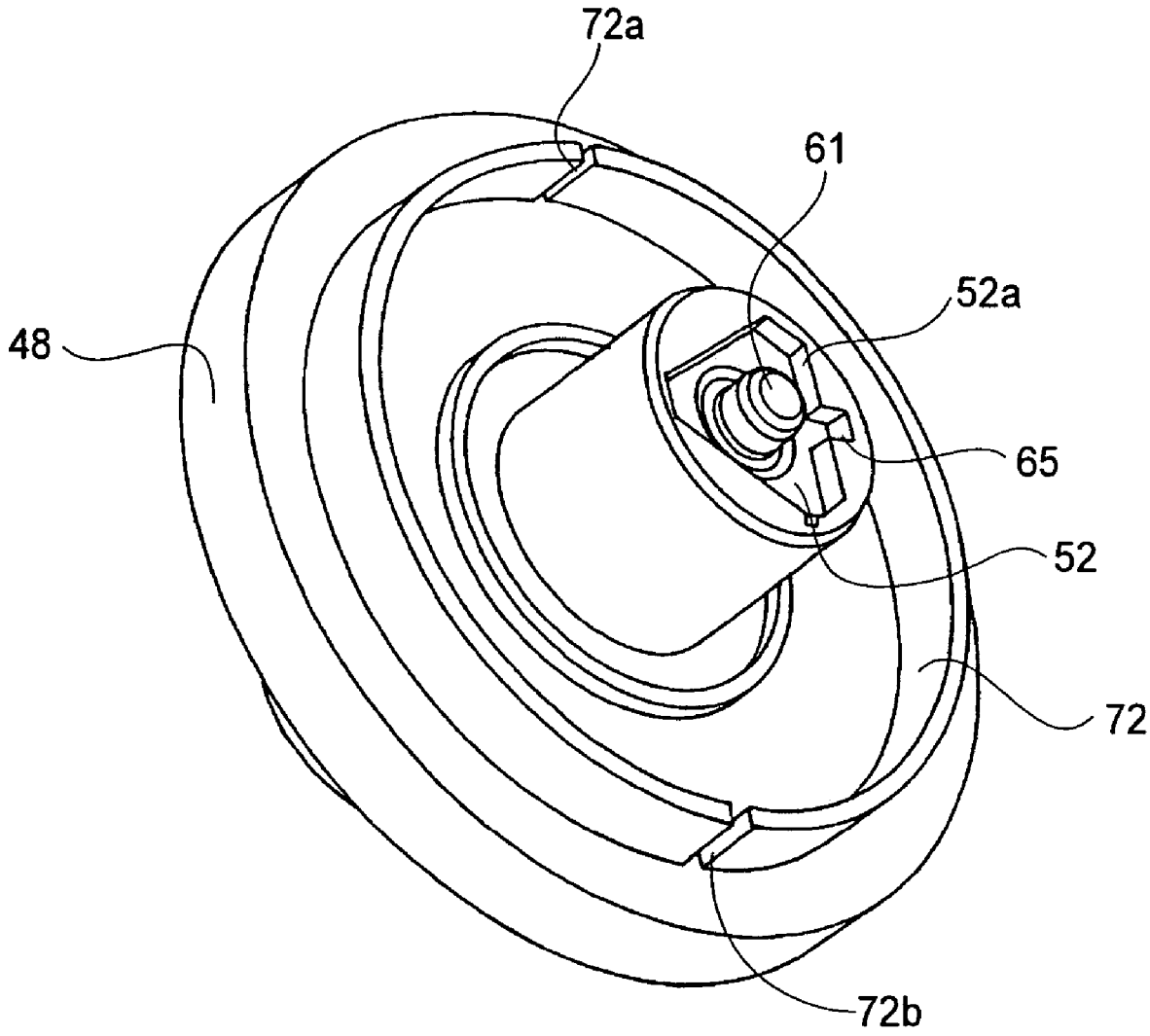
FIG. 6 is a drawing showing the shape of the coupling of the driving unit.
Figure 7:
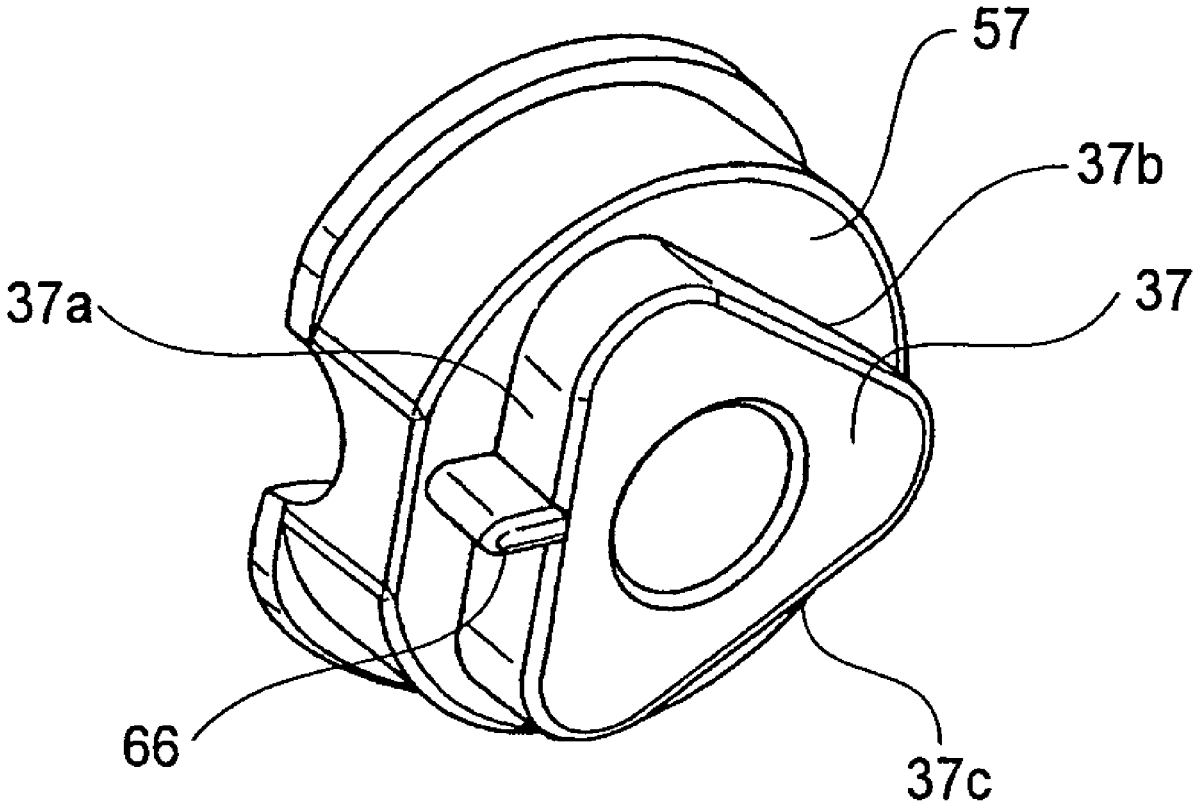
FIG. 7 is a drawing showing the shape of the image bearing member side of the coupling.

FIG. 6 is a drawing showing the coupling recess of the coupling 52, and FIG. 7 is a drawing showing the coupling projection of the coupling 57.

Referring to FIGS. 6 and 7, the coupling recess of the coupling 52 in the form of a twisted pillar, the cross-section of which is in the form of an equilateral triangle. One 52*a* of the lateral surfaces of the coupling recess of the coupling 52 is provided with a key groove 65, whereas one 37*a* of the lateral surfaces of the coupling projection 37 of the coupling 57 is provided with a phase locking rib 66. The key groove 65 and phase locking 66 are structured so that the latter is allowed to fit into the former. Designated by referential symbol 37*b* and 37*c* are the other lateral surfaces of the coupling projection 37 of the coupling 57.

In order to ensure that it takes only a single rotation of theirs relative to each other for the coupling 52 and coupling 57 lock with (or unlock from) each other, the phase locking rib 66 is structured and positioned to ensure that the edge of the lateral surface 52*a* of the equilaterally triangular coupling recess of the coupling 52 comes into contact with the surface 37*a* of the coupling projection 37 of the coupling 57. Until the phase locking rib 66 aligns with the key groove, the coupling projection 37 does not fits into the coupling recess of the coupling 52 even if the drum driving gear 48 begins to be rotated.

As the process cartridge 7 is inserted into the image forming apparatus main assembly, the end surface of the coupling projection 37 presses on the adjacencies of the outward edges of the coupling recess of the coupling 52, causing the drum driving gear 48 to retract outward of the image forming apparatus against the return spring 62, unless the phase locking rib 66 is in alignment with the key groove 65, that is, unless the coupling projection 37 of the coupling 52 fits into the coupling recess of the coupling 52. Then, as the phase locking rib 66 aligns with the key groove 65 during the pre-rotation period (image forming apparatus main assembly is idled for image formation preparation) which occurs immediately after the mounting of the photosensitive drums, the coupling projection 37 instantly fits into the coupling recess of the coupling 52.

As described above, only as the phase locking rib 66 aligns with the key groove 62 in terms of their rotational direction, and the coupling projection 37 of the coupling 57 fits into the coupling recess of the coupling 52, not only are the drum driving gear 48 and photosensitive drum 1*d* precisely positioned relative to each other, and also, relative to the image forming apparatus main assembly, but also, the rotational driving force from the drum motor 45 as a driving force source is transmitted to the coupling projection 37 of the coupling 57. As for the relationship between the rotational phase of the drum driving gear 48 and the rotational phase of the coupling projection 37 of the coupling 57 is determined to only one relationship (uniquely). Incidentally, designated by a referential symbol 61 is a projection which projects from the bottom surface of the coupling recess of the coupling 52.

Figure 8:
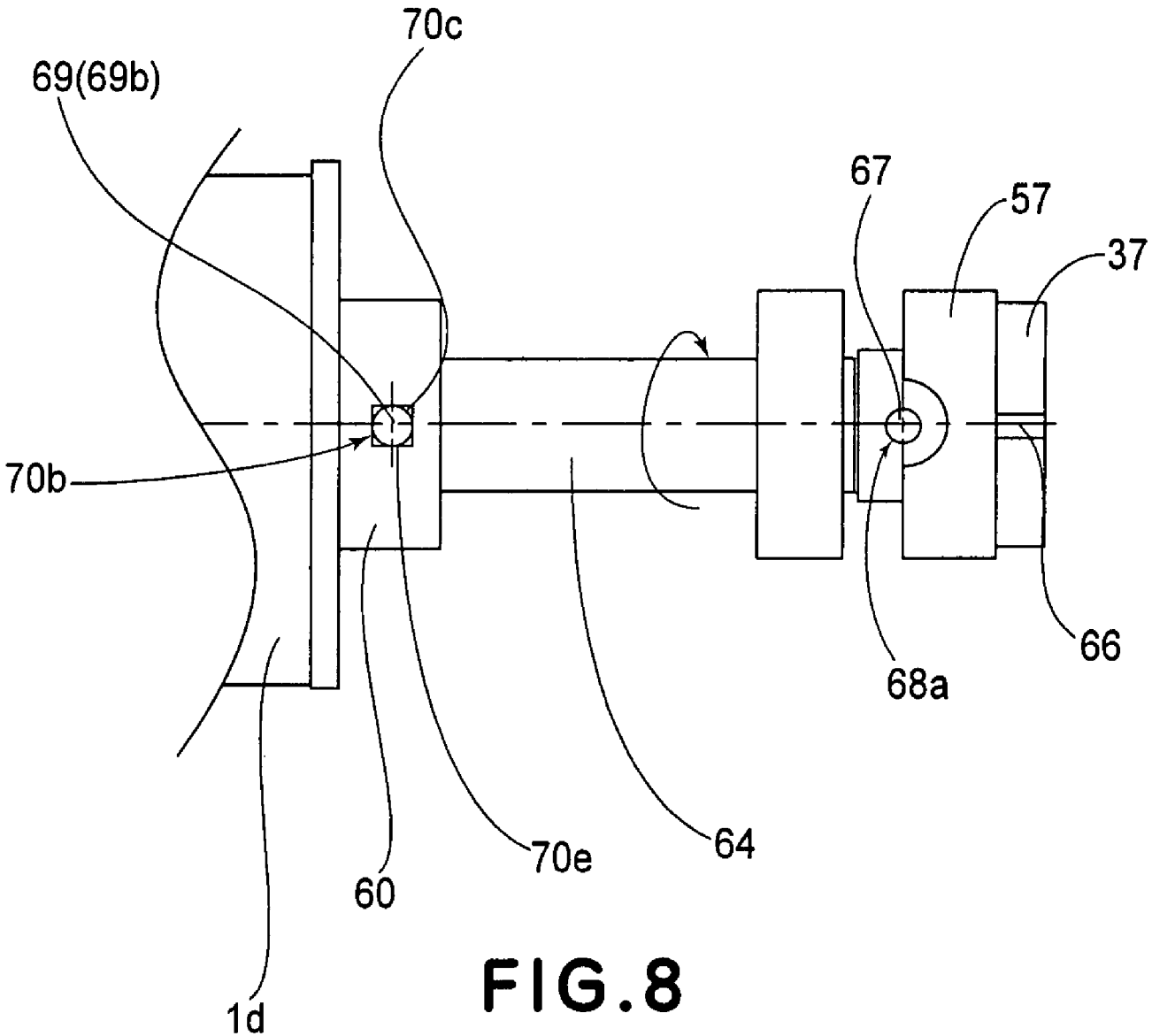
FIG. 8 is a drawing showing the driving portion for driving the image bearing member.
Figure 9:
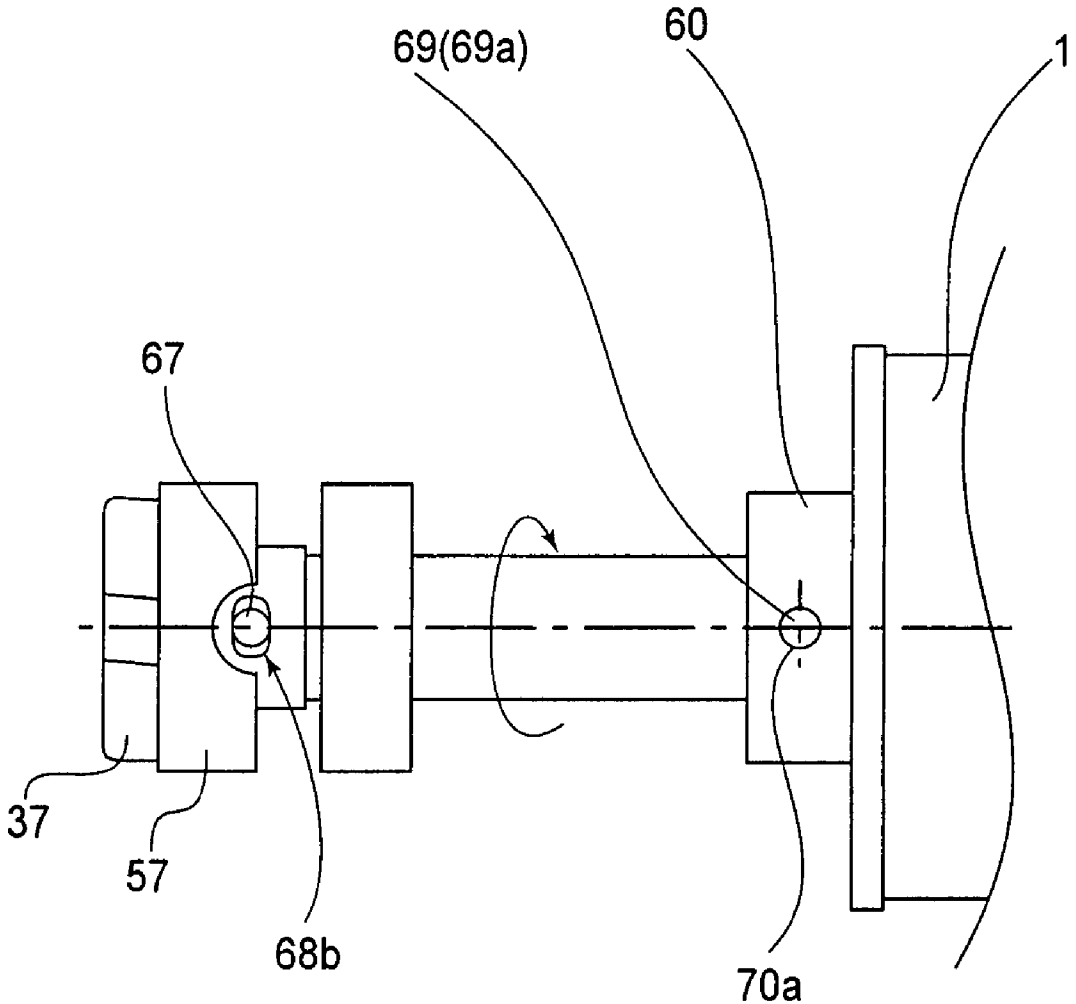
FIG. 9 is also a drawing showing the driving portion for driving the image bearing member.
Figure 10:
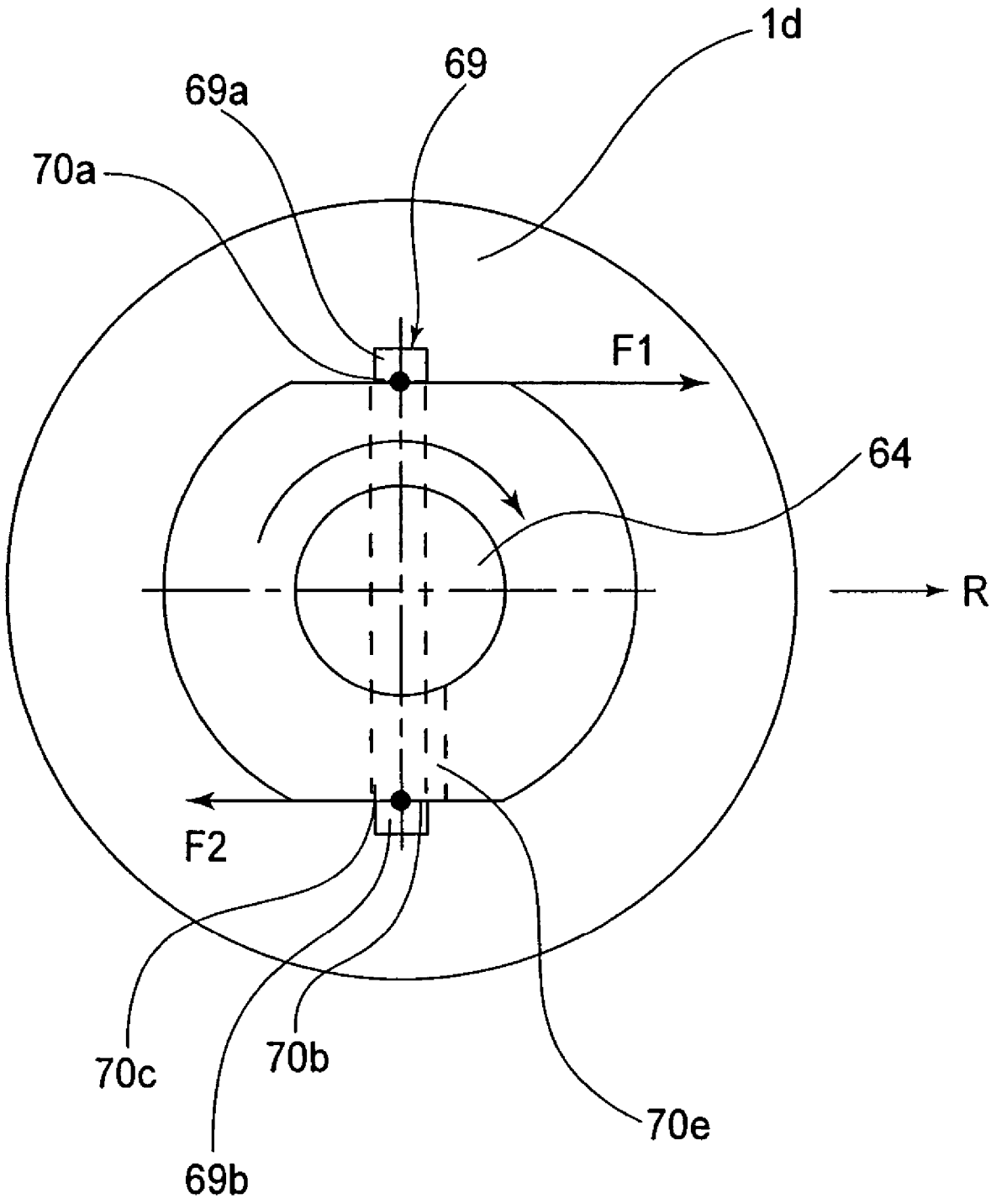
FIG. 10 is a drawing showing the relationship among the stresses to which the image bearing is subjected.

At this time, referring to FIGS. 4, 5, and 8-10, the image bearing unit structure which characterizes this embodiment of the present invention will be described. FIGS. 8-10 are drawings showing the structure of one of the end portions of the image bearing in this embodiment.

The rotatable shaft 64, the axial line of which coincides with that of the photosensitive drum 1*d*, is provided with pin holes 75 and 76 into which spring loaded pins 67 and 69 fit, and which are positioned so that their openings align in the direction parallel to the axial line of the rotatable shaft 64.

The drum coupling 57 is provided with a pin hole 68, into which the springy pin 67 fits as soon as the coupling projection 37 fits into the coupling recess of the coupling 52. This pin hole 68 is in the form of a frustum, one 68*a* of its opening being circular, and the other 68*b* being elongated. The diameter of the circular opening 68*a* is the same in value as the external diameter of the springy pin 67, and therefore, the springy pin 67 fits into the hole 68*a* with no gap. The size of the elongated hole 68*b* is greater in value than the external diameter of the springy pin 67. In other words, the driving point, or the point at which the rotational driving force is transmitted from the drum coupling 57 through the springy pin 68 to the rotatable shaft 64 is limited to a single point of the edge of the circular opening 68*a*.

Further, as the rib 66 of the coupling projection 37 of the coupling 57 aligns with the circular opening 68*a* of the a structural arrangement has been made so that in terms of the circumferential direction of the rotatable shaft 64, the phase locking pin hole 68 as the phase locking rib 66 fits into the key groove 62 of the coupling recess of the coupling 52.

The flange 60, which is the photosensitive drum supporting portion attached to one of the lengthwise ends of the photosensitive drum 1*d*, is provided with a pin hole 70 into which the springy pin 69 fits. One 70*a* of the openings of this pin hole 70 is circular (first engagement portion), and the other 70*b* is rectangular. The diameter of the circular opening 70*a* is the same in value as the external diameter of a part 69*a* (first projection) of the springy pin 69, and therefore, the springy pin 69 fits into the hole 69*a* with no gap. The rectangular opening 70*b* is on the opposite side of the center hole of the flange 60 from the circular hole 70*a*. As for the contact between the springy pin 69 and the surfaces of the rectangular hole 70*a*, only a single point of the peripheral surface of the springy pin 69 contacts the downstream surface of the rectangular hole 70*b*, in terms of the rotational direction of the rotatable shaft 64. The hole 70*b* is rectangular in cross section, and is structured so that the line of contact 70*c* of the hole 70*b*, which is on the downstream side of the springy pin 69, comes into contact with the ridge of the second projection 69*b* of the springy pin 69, but, the springy pin 69 does not comes into contact with the surface of the hole 70*b*; in other words, the size difference in cross section between the hole 70*a* and hole 70*b* is provided by expanding the hole 70*b* in the upstream direction so that when the springy pin 69 is in the pin hole 70, there is a small space 70*e* (gap) between the pin 60 and the upstream side of the hole 70*b*.

In other words, in terms of the rotational direction of the rotatable shaft 64, the first engagement portion 70*a* makes contact with both the downstream and upstream sides of the first projection 69*a*, whereas the second engagement portion 70*b* makes contact with the downstream side of the second projection 69*b*, but leaves the gap 70*e* between itself and the upstream side of the second projection 69*b*.

Incidentally, the first projection 69*a* is one of the lengthwise end portions of the springy pin 69, and the second projection 69*a* is the other lengthwise portion of the springy pin 69.

As the rotation of the rotatable shaft 64 is started, the springy pin 69 comes into contact with the wall of the circular hole portion 70*a* (first driving point), and starts rotating the flange 60, and at the same time, it comes into contact with the contact portion 70*c* (second driving point). While the rotatable shaft 64 is rotated, a rotational driving force F1 and a rotational driving force F2 are applied to the drum flange 60 at the circular hole portion 70*a* (first driving point) and rectangular hole portion 70*c*, respectively.

In the circular hole portion 70*a* (first driving point), the springy pin 69 is fitted with no gap. Therefore, even if the reaction force of the driving force F1 acts on the springy pin 69, it is unlikely that the circular hole portion 70*a* and/or springy pin 69 is deformed. Therefore, the amount by which the driving force is lost at this driving force transmission point is small. In the case of the rectangular hole 70*b*, however, only the downstream side of the springy pin 69 makes contact with the wall of the rectangular hole 70*b* (contact portion 70*c*), leaving the space 70*e* between the upstream side of the springy pin 69 and wall of the rectangular hole 70*b*. Therefore, if reactive force is generated by the driving force F2 at the contact line between the contact portion 70*c* and springy pin 69, the springy pin 69 is deformed by the reaction force, canceling the driving force.

Therefore, F1>F2. Thus, the above described structural arrangement in this embodiment makes the photosensitive drum 1*d* synchronize in rotational phase with the circular hole 70*a* (first driving line) at which the driving force is transmitted by the larger amount. However, as the rotatable shaft 64 is rotated, the driving force F2 is also applied to the flange 60. In other words, couple (F1 and F2) is applied to the flange 60. Therefore, the driving force is prevented from creating a force R which acts in the direction to shift the photosensitive drum 1*d* in position. As a result, the driving force is efficiently transmitted to the photosensitive drum 1*d*. The rotational driving forces which act on the flange 60 at the first and second driving points, respectively, are roughly parallel to each other, and opposite in direction.

The rotational phase of the photosensitive drum 1*d* is determined by the circular hole 70*a*, which provides the first driving point at which a greater portion of the driving force is transmitted. In other words, the phase locking rib 66 of the coupling projection 37, circular hole 68*a*, pin holes 75 and 76, circular hole 70*a*, of the photosensitive drum unit are determined uniquely.

Further, as for the relationship between the rotational phases of the coupling projection 37, and the rotational phase of the coupling recess of the coupling 52, they are simply determined by the phase locking rib 66 and key groove 65, are determined to a unique position as described before. Therefore, the drum driving gear 48, drum coupling 57, rotatable shaft 64, flange 60, and photosensitive drum 1*d* can all be synchronized in rotational phase.

Further, referring to FIGS. 4-6, in order to make it possible to detect the rotational phase of the drum driving gear 48, the drum driving gear 48 is provided with a rotational phase detection rib 72.

The phase detection rib 72 is provided with a pair of slits 72*a* and 72*b*, which are different in width, and the image forming apparatus main assembly is provided with a phase detecting portion 71 as a phase detecting device. Thus, as the drum driving gear 48 is rotated, the phase detecting device of the main assembly detects the passage of the slits 72*a* and 72*b*, instantly detecting thereby the rotational phase of the drum driving gear 48.

With the provision of the above described structural arrangement, the rotational phases of the four drum driving gears 48 (one for each of four primary colors) can be detected by the corresponding phase detecting portions 71 at the end of the pre-rotation of the photosensitive drums, which occurs which the image forming apparatus is started up. Thus, it is possible to control the rotation of the motor 45 by the control device so that the drum driving gears 48 are stopped at positions taking into account the phase deviations. Therefore, when a printing job is started, the four photosensitive drums 1*a*, 1*b*, 1*c*, and 1*d* are the same in rotational phase, preventing the formation of an image suffering from the color misregistration in terms of the secondary scan direction, attributable to the asynchronism in rotational phase among the four photosensitive drums.

Figure 13:
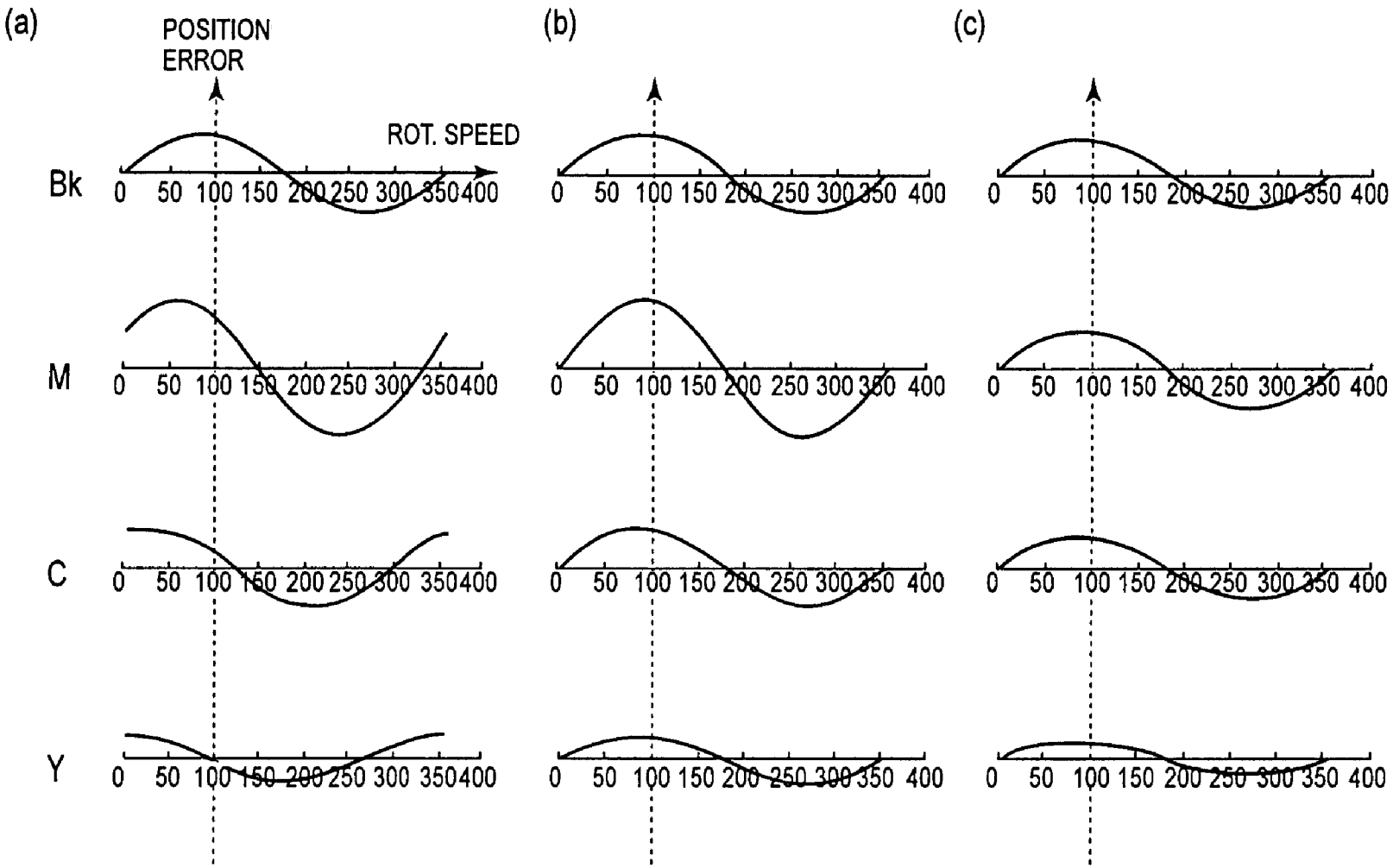
FIGS. 13(*a*)-13(*c*) are graphs showing the relationship between the angle of rotation and the positional error.

The effectiveness of the present invention can be described with reference to FIG. 13, which shows the difference between the image forming apparatus described in the background technology section of this specification, and the image forming apparatus structured in accordance with the present invention. FIG. 13 is a drawing showing the amount of the deviation (from theoretically correct angle) of each of the image bearing members for the four primary colors, relative to the rotational angle of the corresponding rotatable shaft. In each graph in the drawing, the print start point is represented by a broken line.

Figure 11:
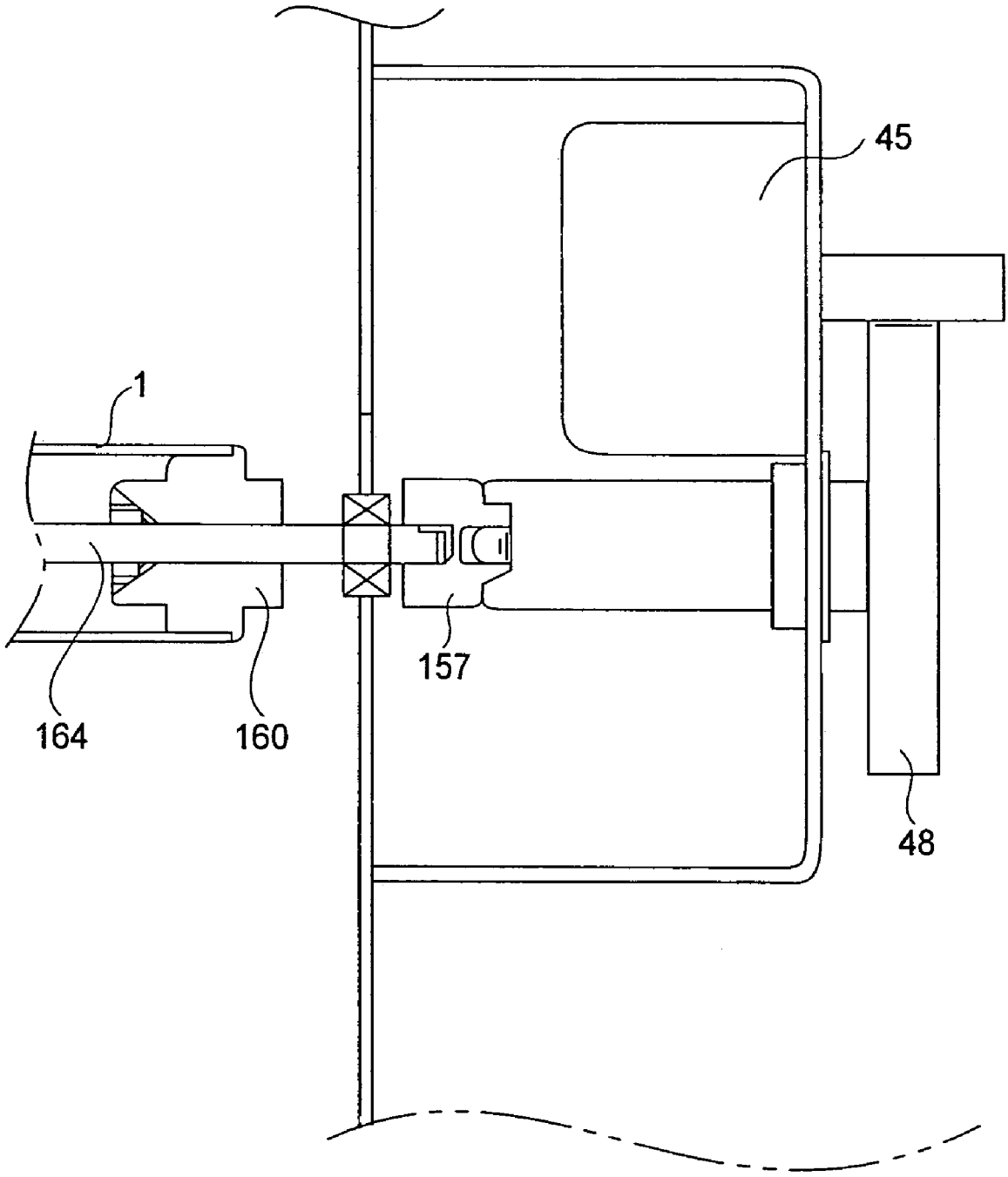
FIG. 11 is a drawing showing the state of connection between the driving unit and image bearing member, which is in accordance with the background technologies of the present invention.
Figure 12:
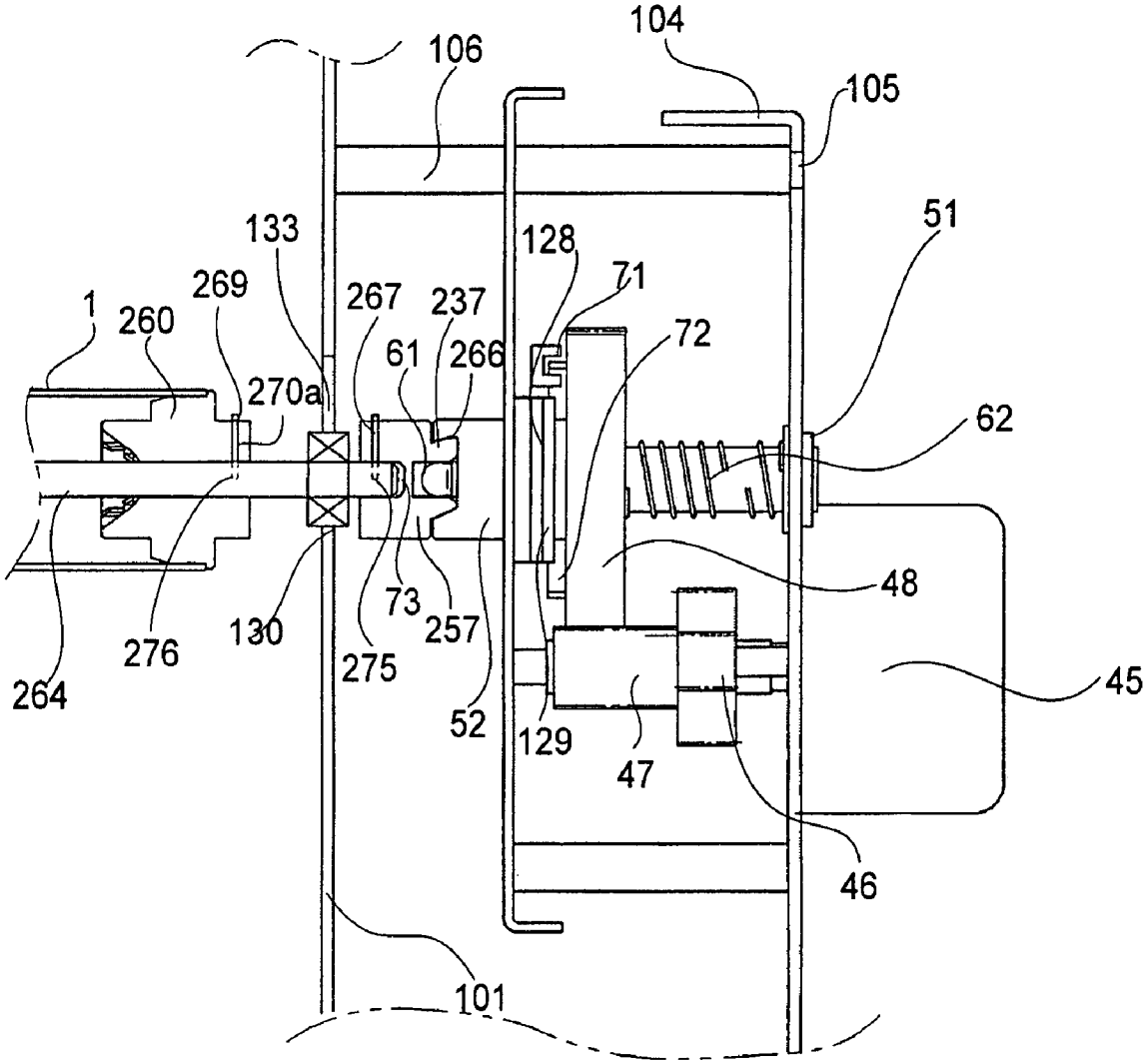
FIG. 12 is a drawing showing the state of connection between the driving unit and image bearing member, which is in accordance with the background technologies of the present invention.

FIG. 11 is a drawing showing the structural arrangement of the photosensitive drum unit in accordance with the background technologies, in which a flange 160 and rotatable shaft 164 are attached to each other by pressing the latter into the former, or the like method, that is, without using a springy pin or the like. FIG. 12 is a drawing showing the structural arrangement of the photosensitive drum unit in accordance with the background technologies, in which a flange 260 and rotatable shaft 264 are locked to each other with the use of a springy pin 269 so that the point of driving force transmission to the flange 260 and photosensitive drum 1 is limited to a single point of the surface of the circular hole 270*a*.

FIG. 13(*a*) is a drawing showing the differences in rotational phase among the four photosensitive drums for four primary colors, one for one. It represents the case in which an image suffering from color misregistration is formed, and in which the extent of the color misregistration is related to the amount of the deviation in rotational phase of each photosensitive drum 1 at the print start point. The amount of the deviation in rotational phase is represented by the amplitude in each graph. In this case, the flange 160 and rotatable shaft 164 are fastened to each other by the method of pressing the latter into the center hole of the former as shown in FIG. 11, or the like method. Therefore, the rotation phase of the flange 160 is not controlled in relation to the those of the rotatable shaft 164, drum coupling 157, and drum driving gear 48. Therefore, even if the motor 45 is controlled in response to the detected rotational phase of the drum driving gear 48, the four photosensitive drums, which correspond to four the primary colors, one for one, become different in rotational phase, which results in the formation of an image suffering from the above described color misregistration. Also in this case, even if the deviations in rotational phase are compensated for, by the above described formation of a positional deviation detection pattern, it is not always that the deviations in rotational phase are completely corrected, since there is a limit to the accuracy with which the photosensitive drums can be adjusted in rotational phase, that is, there will be some adjustment errors. Further, if the four photosensitive drum units are nonuniform in the amount of the deviation in the rotational phase of a photosensitive drum, because of the nonuniformity attributable to a difference in cavity among the molds, difference in lot and/or cartridge manufacturing units.

FIG. 13(*b*) is a drawing showing the differences in rotational phase among the four photosensitive drums for the four primary colors, one for one, of the image forming apparatus shown in FIG. 12. The apparatus shown in FIG. 12 is structured so that the point of driving force transmission to the flange 260 and photosensitive drum 1 is limited to the single point of the circular hole 270*a*, as described above, and also, so that the relationships in terms of rotational phase among the flange 260, rotatable shaft 264, drum coupling 257, and drum driving gear 48 is determined to the predetermined unique relationships set (controlled) by the phase locking rib 266 and springy pins 267 and 269. Incidentally, designated by referential symbols 275 and 276 are the pin holes of the rotatable shaft 264, into which the springy pins 267 and 269 fit, and designated by a referential symbol 237 is the coupling projection of the coupling 257. In the case of this structural arrangement, the four photosensitive drums perfectly coincide in rotational phase at the print start point. Therefore, it does not occur that an image suffering from the color misregistration attributable to the difference in rotational phase among the four photosensitive drums. In other words, the image forming apparatus forms an image which is relatively good in terms of the level of color misregistration. In the case of this structural arrangement, however, there is only one driving point, or the point at which driving force is transmitted to the photosensitive drum 1, as described above. Therefore, as the driving force is transmitted to the photosensitive drum 1, the aforementioned force R is generated, which acts in the direction to shift the photosensitive drum 1 in position. As a result, the rotational force is not efficiently transmitted. Consequently, the photosensitive drum 1 increases in the fluctuation (amplitude in the graph) in the rotational phase (peripheral velocity). Incidentally, if the rotation variation among the photosensitive drums due to the unevenness due to the cavity difference, lot difference and/or cartridge unit difference occurs, as shown in FIG. 13(*b*), the color misregistration still arises since the amplitude of the rotational variation per se is large.

FIG. 13(*c*) is a drawing showing the difference in rotational phase among the four photosensitive drums photosensitive drums 1*a*, 1*b*,1*c*, and 1*d* for the four primary colors, one for one, of the image forming apparatus in this embodiment. In the case of the structural arrangement in this embodiment, the first driving point (circular hole 70*a*), not only is the first driving point is provided, at which the rotational driving force is transmitted to the flange 60 from the rotatable shaft 64, and which controls the rotational phase of the flange 60 (photosensitive drum 1), but also, the second driving point (contact point between springy pin 69 and wall of rectangular hole 70*b*) is provided as the auxiliary driving point, that is, a driving point, which is smaller, in the amount by which the rotational driving force is transmitted from the rotatable shaft 64 to the drum flange 60, than the first driving point, are provided.

In the case of this structural arrangement, the four photosensitive drums perfectly coincide in rotational phase at the print start point, as in the case of the structural arrangement shown in FIG. 13(*b*). Therefore, it does not occur that an image suffering from the color misregistration attributable to the difference in rotational phase among the four photosensitive drums is formed. In addition, this structural arrangement provides a rotational couple (force transmitted at first driving point and force transmitted at second driving point). Therefore, the rotational driving force is efficiently transmitted to the photosensitive drum 1, minimizing the amount of changes in peripheral velocity, that is, the changes in rotational phase itself. In the case of this structural arrangement, therefore, even if the rotation variation among the photosensitive drums due to the unevenness due to the cavity difference, lot difference and/or cartridge unit difference occurs, the ifluence to the color misregistration is small since the amplitude of the rotational variation per se is small. in this manner, the color misregistration is minimized.

As has been described above, in this embodiment of the present invention, the flange 60 is provided with the first driving point, not only at which the rotational driving force of the rotatable shaft 64 is transmitted to the flange 60, but also, which controls the flange 60 in rotational phase, and the second driving point as an auxiliary driving point, which is smaller in the amount by which the rotational driving force is transmitted to the flange 60 than the first driving point. Therefore, the rotational driving force from the drum motor 45 generates driving force couple which act at the first and second driving points, reducing the photosensitive drum 1 in the amount of fluctuation in peripheral velocity. In other words, this embodiment can stabilize the photosensitive drum 1 in peripheral velocity.

With the provision of the above described structural arrangement, it is possible to minimize the amount of color misregistration, even if the four photosensitive drums for the four primary colors, one for one, become nonuniform in the amount of the changes in peripheral velocity, because of the cavity difference, lot difference and/or unit difference with respect to the drum driving gear 48, the drum coupling 57, the coupling recess, the flange 60 and the process cartridge unit.

Further, in terms of the circumferential direction of the flange 60, the first and second driving points are positioned roughly 180 degrees apart. Therefore, the portion of rotational driving force transmitted at the first driving point and the portion of the rotational driving force transmitted at the second driving point create driving force couple. Therefore, the rotational driving force from the drum motor 45 is efficiently transmitted to the flange 60 (photosensitive drum 1), minimizing the fluctuation in the peripheral velocity of the photosensitive drum 1.

Further, the rotational phase of the drum coupling is determined to the first driving poing where the flange 60 and the rotational shaft 6 with which the photosensitive drum 1 is supported. Therefore, even if multiple photosensitive drums deviate in peripheral velocity, the photosensitive drums can be made to coincide in rotational phase, simply by making the drum couplings 57 by which the driving force from the image forming apparatus main assembly are received by the photosensitive drums, coincide in rotational phase. Therefore, it is possible to easily minimize the extent of the color misregistration (attributable to the difference in rotational phase among the multiple photosensitive drums), with which an image is formed.

Further, not only is the image bearing unit structured so that the relationships, in rotational phase, among the flange 60 with which the photosensitive drum is supported on the rotatable shaft 64, rotatable shaft 64, and drum coupling 57 are simultaneously and automatically uniquely fixed, but also, so that the drum driving gear 48, drum coupling 57, coupling recess of the coupling 52, which is in the inward end of the drum driving gear 48, and into which the drum coupling projection 37 of the drum coupling 58 fits, synchronize in only one rotational phase.

Therefore, even if multiple photosensitive drums randomly fluctuate in peripheral velocity, all photosensitive drums can be made to simultaneously coincide in rotational phase, simply by making the drum driving gears 48 coincide in rotational phase. Therefore, the image forming apparatus can be easily reduced in the extent of color misregistration (attributable to the difference in rotational phase among multiple photosensitive drums).

Further, if the multiple photosensitive drums deviate in peripheral velocity at different levels, all the photosensitive drums can be made to simultaneously coincide in rotational phase, simply by detecting the rotational phase of each photosensitive drum, and then, compensating each photosensitive drum for its detected amount of deviation in rotational phase so that all drum driving gears 48 coincide in rotational phase. Therefore, it is possible to easily reduce the image forming apparatus, in the extent of the color misregistration (attributable to differences in rotational phase among multiple photosensitive drums).

As described above, by the employment of an image bearing unit and an image bearing member driving structure such as those described above, the image forming apparatus main assembly can be maintained to be minimized in the extent of the color misregistration which occurs in the primary scan direction because of the deviation in the positional relationship between the exposing device and image bearing member (photosensitive drum), and also, to improve an image forming apparatus in terms of the color misregistration in the scan direction, which is attributable to the exposing device. In addition, even if two or more image bearing members deviate in peripheral velocity (rotational phase), the image bearing members can be precisely compensated for the deviation, without making a user wait for a long time. In other words, an image forming apparatus can be easily reduced in the color misregistration in the secondary scan direction, which is attributable to the deviation in peripheral velocity which occurs to two or more image bearing members.

Further, with the provision of two driving points such as the above described first and second driving points, the influence to the rotational speed of the image bearing members due to the parts cavity difference, the lot difference and the unit difference (the difference among the individual cartridges), and the resultant color misregistration, can be minimized.

Next, the other embodiments of the present invention will be described. The basic structure of the image bearing unit in this embodiment is the same as that in the above described embodiment of the present invention. Therefore, the description of this embodiment will be directed to the portions of the image bearing unit in this embodiment, which are different from those in the preceding embodiment.

Figure 14:
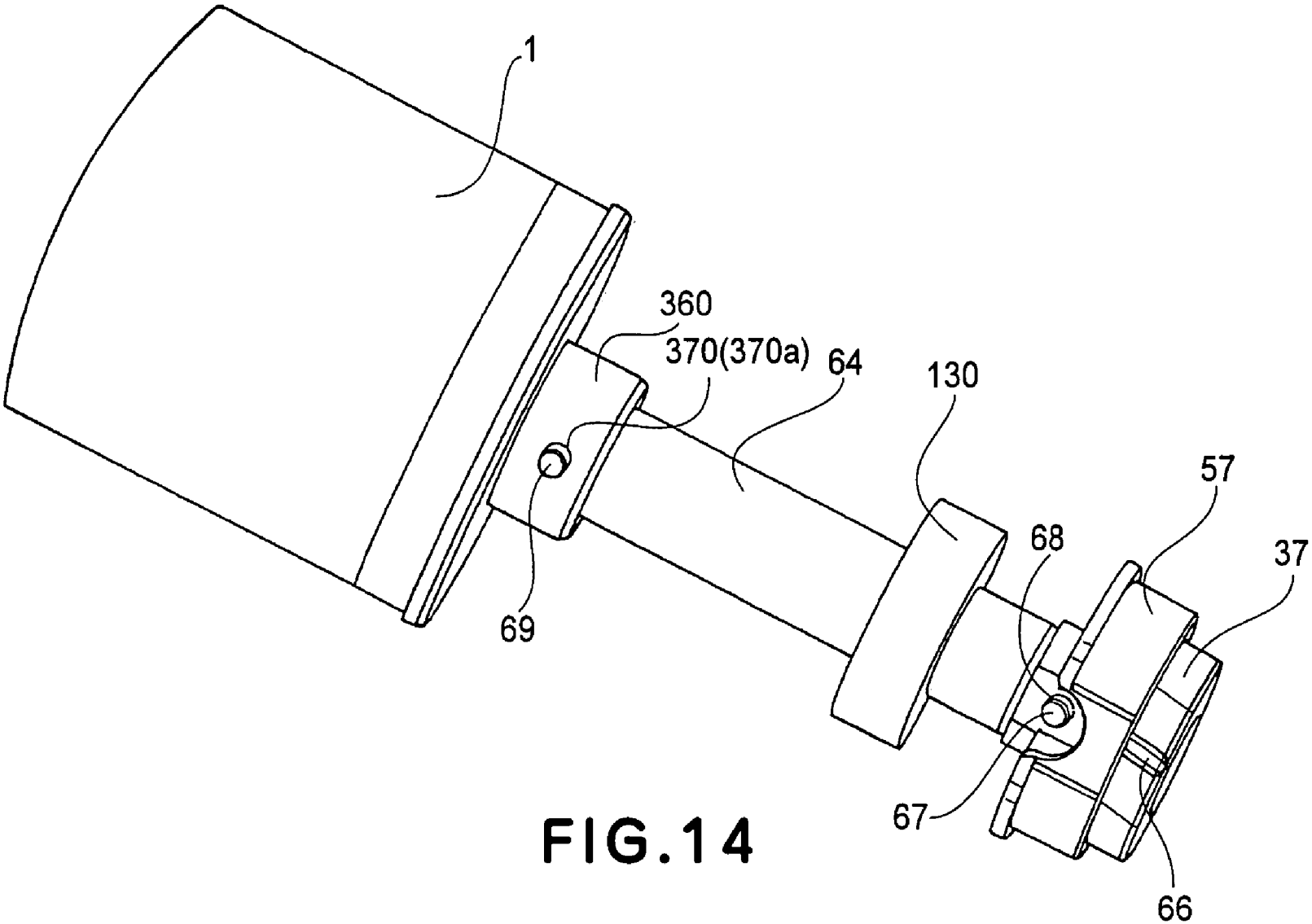
FIG. 14 is a drawing showing the driving portion for driving an image bearing member, in another embodiment of the present invention.
Figure 15:
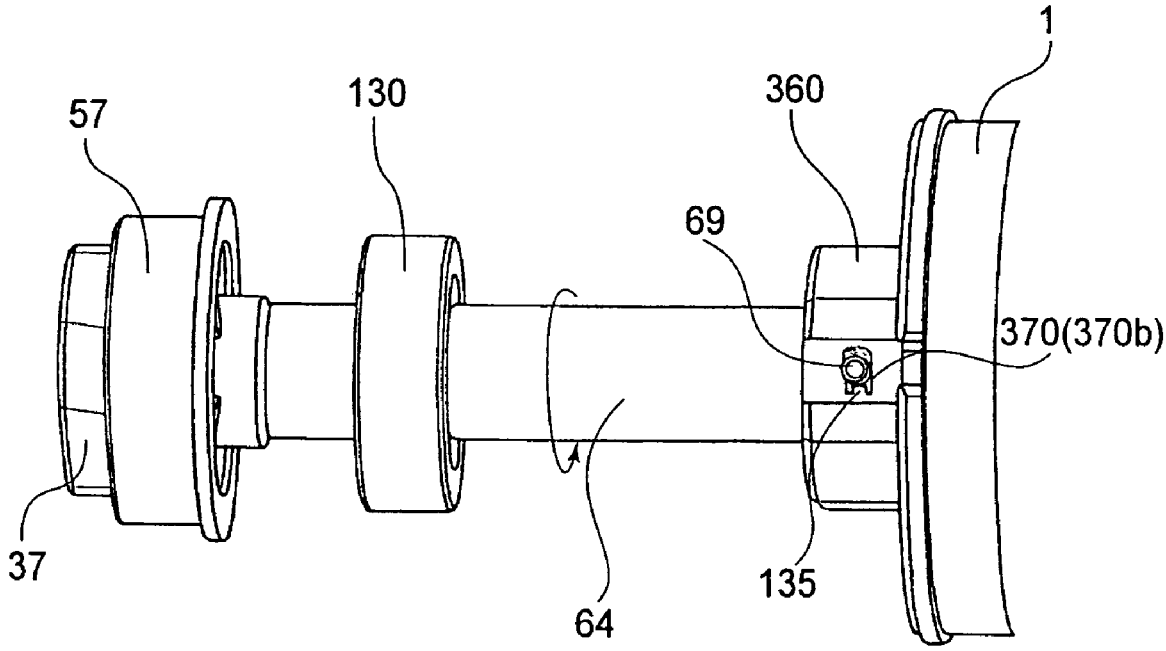
FIG. 15 is a drawing showing the driving portion for driving an image bearing member, in yet another embodiment of the present invention.
Figure 16:
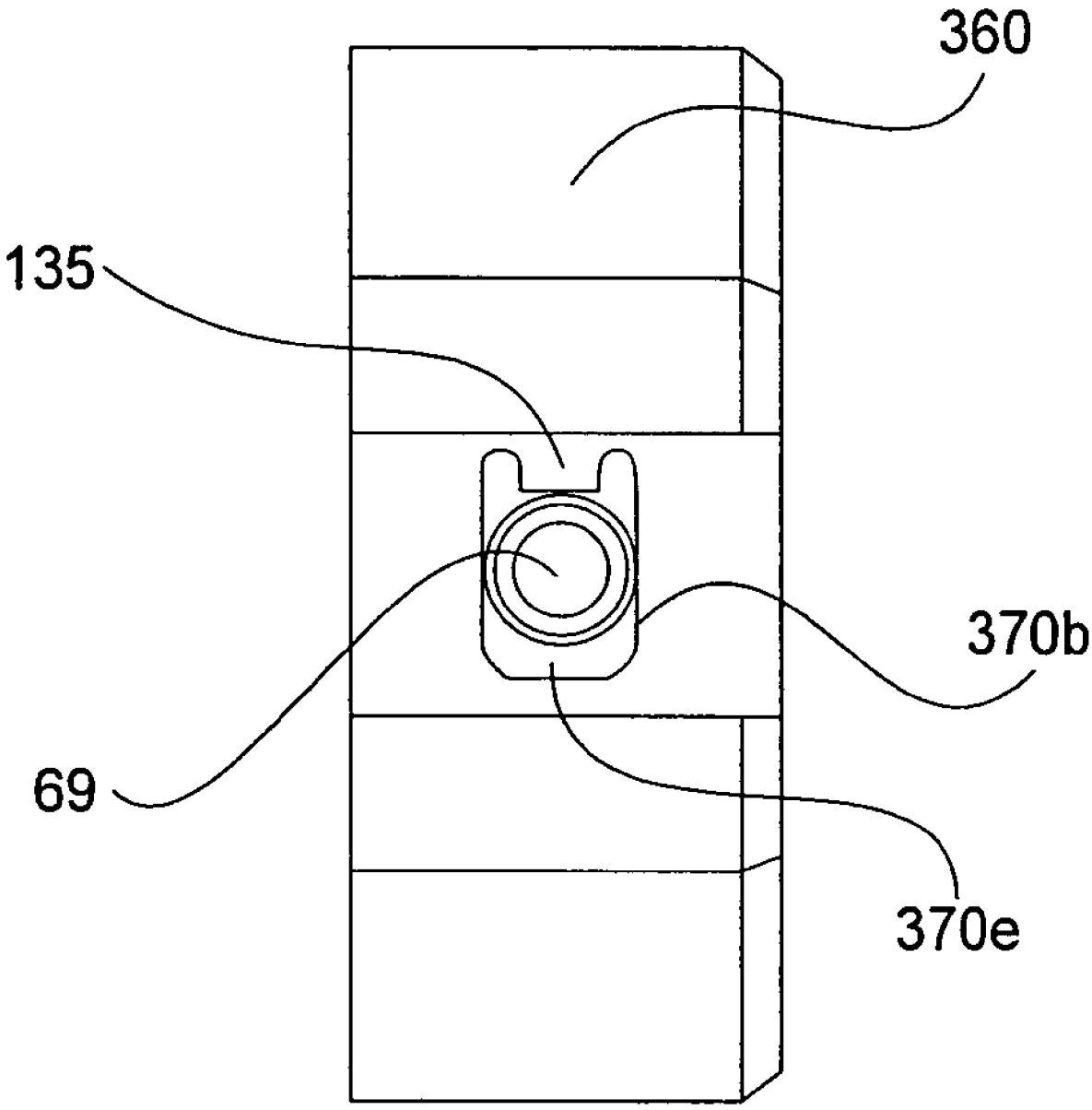
FIG. 16 is a drawing showing the structure of the flange of the image bearing member.

First, referring to FIGS. 4, 5, and 14-17, the structure of the image bearing unit in this embodiment, which characterizes this embodiment, will be described. FIGS. 14-16 are drawing showing the image bearing unit in this embodiment.

The rotatable shaft 64 which supports the image bearing member so that the former and the latter coincide in rotational axis is provided with pin holes 75 and 76 into which springy pins 67 and 69 are inserted. The pin holes 75 and 76 are positioned so that they coincide in rotational phase.

The drum coupling 57 is provided with a coupling projection 37, which is located at the end of the drum coupling 57, and a pin hole 68 into which the springy pin 67 is inserted. This pin hole 68 is made up of two portions 68*a* and 68*b*. The portion 68*a* is circular in cross section, and its diameter is the same in value as the external diameter of the springy pin 67. The portion 68*b* of the pin hole 68 is on the opposite side of the center hole 73 of the drum coupling 57 from the portion 68*a*. It is elongated in cross section, and therefore, it does not come into contact with the peripheral surface of the springy ping 67. Thus, the point at which the rotational driving force is transmitted to the rotatable shaft 64 though the springy pin 67 is limited to a single point of the pin hole portion 68*a* with the circular cross section. Incidentally, the abovementioned center hole 73 is the hole into which the rotatable shaft 64 fits.

Further, the coupling projection 37 is provided with the phase locking rib 66, which is positioned so that it is made to coincide in rotational phase with the abovementioned the circular pin hole portion 68*a*, by the drum coupling 57 in unique phase relation.

Further, a flange 360 attached to one of the lengthwise ends of the photosensitive drum 1 is provided with pin holes 370 into which a springy pin 69 is inserted. This pin hole 69 includes two portions 370*a* and 370*b*. The portion 370*a* is circular in cross section, and its diameter is the same in value as the external diameter of the springy pin 69. Therefore, when the springy pin 69 is in this portion 370*a* of the pin hole 370, there is no gap between the springy pin 69 and the surface of this portion 370*a* of the pin hole 370. As for the portion 370*b* of the pin hole 370, it is on the opposite side of the center hole 74 of the flange 360 from the circular portion 370*a*. It is only the upstream side of this portion 370*b* of the pin hole 370, in terms of the rotational direction, that the peripheral surface of the springy pin 69 comes into contact with. Incidentally, the center hole 74 of the flange 360 is the hole into which the rotatable shaft 64 fits.

Referring to FIGS. 15 and 16, the surface of the portion 370*b* of the pin hole 370 is provided with a small projection 135, which is on the downstream side of the portion 370*b*, in terms of the rotational direction of the springy pin 69. In other words, the portion 370*b* of the pin hole 370 is shaped so that its upstream side does not come into contact with the peripheral surface of the springy pin 69, that is, so that when the springy pin 69 is in the portion 37*b* of the pin hole 69, there is a space 370*e* (gap). Thus, as the rotation of the rotatable shaft 64 begins, the springy pin 69 fits into the portion 370*a* (with circular cross section) of the pin hole 3. As a result, not only does the spring pin 69 starts to rotate the flange 360, but also, it comes into contact with the tip of the projection 135. This projection 135 is structured so that it elastically deforms.

Figure 17:
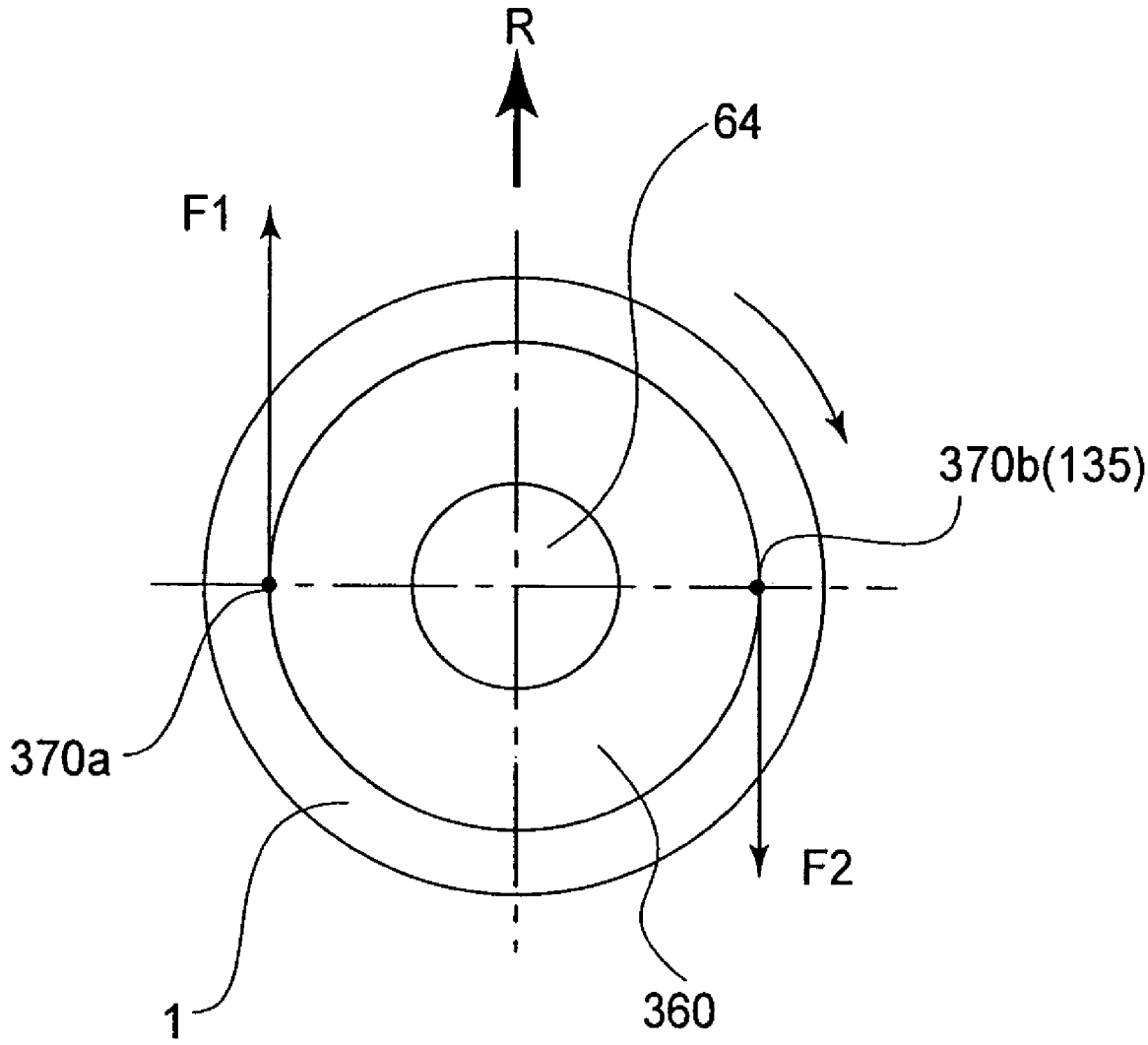
FIG. 17 is a drawing showing the relationship among the stresses to which the image bearing member is subjected.

FIG. 17 is a drawing showing the relationship among the stresses to which the image bearing unit is subjected.

As shown in this Figure, when the photosensitive drum 1 is rotated with the load torque, the strength of the projection 135 is lower than the round hole portion 370*a*, and therefore, the projection 135 slightly deforms, and a rotational driving force F2 which is smaller than the rotational driving force F1 by the round hole portion 370*a* is applied to the flange member 360, at the end portion of the projection 135, due to the influence of the deformation.

A second driving point (auxiliary driving point) by the projection 135 is provided at the position on the flange member 360 (the position approx. 180 degrees away from the first driving point) opposite from the round hole portion 370*a* (first driving point) to which the rotational driving force F1 is applied, thus producing a couple force F2 against rotational driving force F1 to resist the force R tending to displace the photosensitive drum 1, by which the rotational driving force F can efficiently rotate the drum. Here, the rotational driving forces applied at the first driving point and the second driving point are on different lines of action, and are parallel with each other and opposite in direction.

The rotational phase of the photosensitive drum 1 is determined by the round hole portion 370*a* (first driving point) which applies the relatively larger rotational driving force. The rotational phases of all of the phase positioning rib 66, the round hole portion 68*a*, the pin hole 75, the pin hole 76 and the round hole portion 370*a* in the male coupling projection 37 in the photosensitive drum unit can be uniquely determined.

Figure 18:
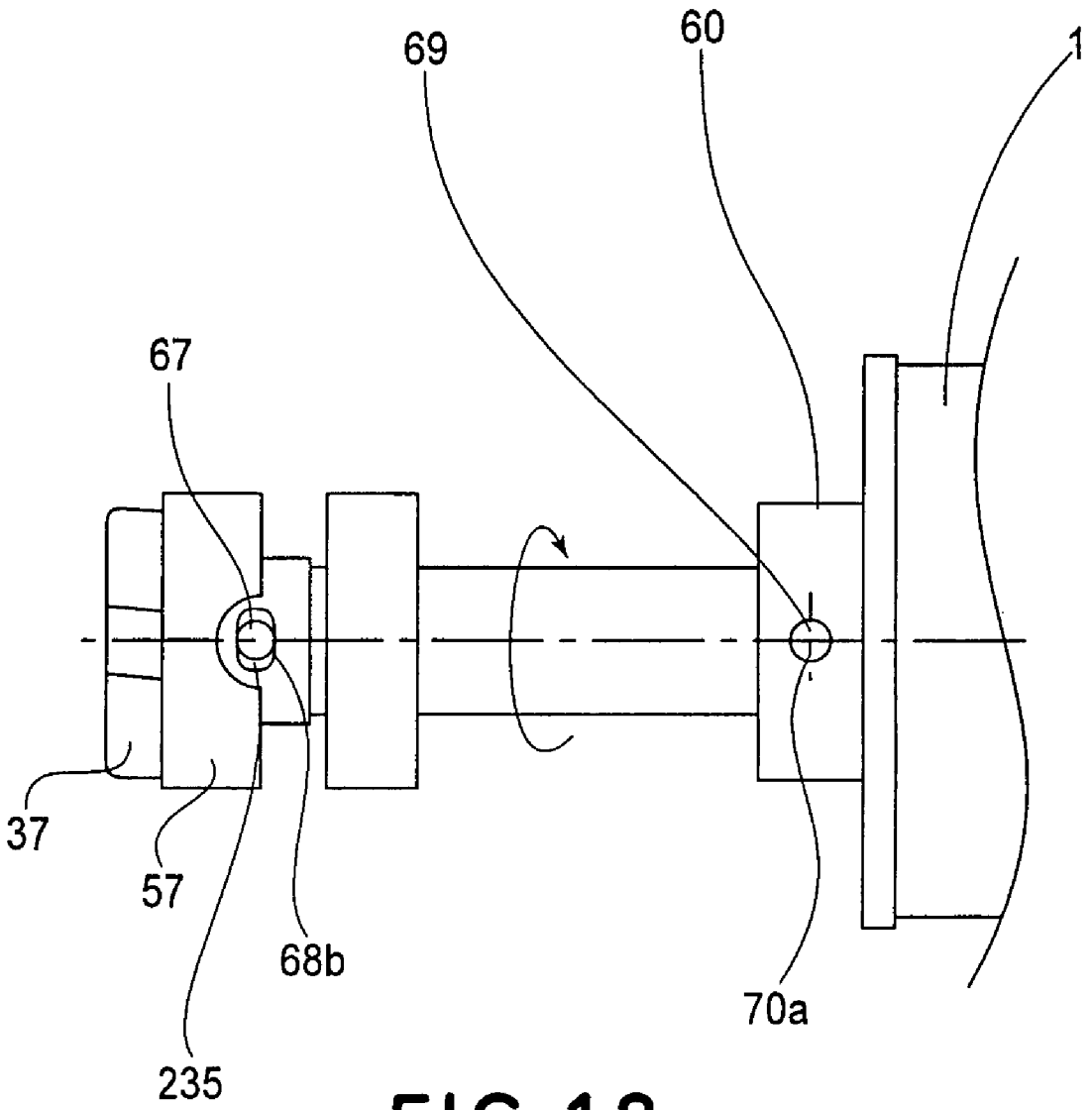
FIG. 18 is a drawing showing the driving portion for driving the image bearing member.

In addition to the structure described above, the elongated hole portion 68*b* in the drum coupling 57 may be provided with a small projection 235 (FIG. 18) (fourth driving point) at a position upstream of the spring pin 67 with respect to the rotational direction, similarly to the hole portion 370*b*. The driving force transmitted to the shaft at the fourth driving point is smaller than the driving force transmitted at the third driving point.

By the additional provision of a structure for producing the couple force against the rotational driving force applied to the round hole portion 68*a* (third driving point), the effects similar to the foregoing embodiments are provided. The third driving point and the fourth driving point are different in the rotational phase by approx. 180 degrees on the coupling 57.

As described in the foregoing, the male coupling projection 37 and the female coupling recess 52 are uniquely determined in the rotational phase by the positioning rib 66 and the keyway 65, and therefore, the rotational phases of the drum driving gear 48, the drum coupling 57, the rotation shaft 64, the flange member 60 and the photosensitive drum 1 are all aligned.

According to the embodiments of the present invention, the rotational driving force for the rotation shaft 64 is transmitted to the flange member 360, and there are provided a first driving point (round hole portion 370*a*) effective to determine the rotational phase and an auxiliary (second) driving point (projection 135) for producing a driving force smaller than the rotational driving force at the first driving point, so that couple force against the rotational driving force for the photosensitive drum 1 can be provided, so that rotational speed variation of the photosensitive drum 1 can be reduced. According to this embodiment, projection 135 is elastically deformable, and therefore, the force at the second driving point can be made subsidiary to the first driving point.

Thus, a stable phase alignment of the photosensitive drum rotation can be provided without an operation of a phase detection sequence which is time consuming, and the speed variation of the photosensitive drum (rotational variation) can be suppressed, thus reducing the image misregistration.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 360143/2004 and 348086/2005 filed Dec. 13, 2004 and Dec. 1, 2005, respectively which are hereby incorporated by reference.

What is claimed is:

1. An image forming apparatus comprising:

an image bearing member, wherein a toner image is formed on said image bearing member and is transferred onto a recording material, thus forming an image on the recording material;

a shaft for rotating said image bearing member, wherein said shaft is provided with a first projection and a second projection, and said image bearing member is provided with a first engaging portion and a second engaging portion which are engageable with said first projection and said second projection, respectively, and wherein said first engaging portion is abuttable to said first projection at downstream and upstream sides of said first projection with respect to a rotational direction of said shaft, and said second engaging portion is abuttable to said second projection at a downstream side of said second projection with respect to a rotational direction of said shaft, and wherein a gap is provided between said second engaging portion and said second projection at an upstream side of said second projection with respect to a rotational direction of said shaft.

2. An apparatus according to claim 1, wherein said image bearing member includes a cylindrical portion and a supporting portion supporting said cylindrical portion, and wherein said first engaging portion and said second engaging portion are provided on said supporting portion.

3. An apparatus according to claim 1, wherein said first engaging portion is in the form of a round hole, and said second engaging portion is in the form of a rectangular hole.

4. An apparatus according to claim 1, wherein said first projection and said second projection include a pin.

5. An apparatus according to claim 4, wherein said pin penetrates said shaft, and one end of said pin constitutes said first projection, and the other end of said pin constitutes said second projection.

6. An apparatus according to claim 1, wherein a portion of said second engaging portion abuttable to said second projection is elastically deformable.

7. An apparatus according to claim 6, wherein a driving force applied by said shaft to said image bearing member at the abutting portion between said second projection and said second engaging portion is smaller than a driving force applied by said shaft to said image bearing member at the abutting portion between said first projection and said first engaging portion.

8. An apparatus according to claim 1, wherein a first driving portion for transmitting a driving force to said first engaging portion from said first projection and a second driving portion for transmitting a driving force to said second engaging portion from said second projection, are separately from each other by approximately 180 degrees with respect to a rotational direction of said shaft.

9. An apparatus according to claim 1, further comprising:

a plurality of such image bearing members, on which different color toner images are formed, and the different color toner images are sequentially transferred onto the same recording material.

10. An apparatus according to claim 1, further comprising:

a transmission member for receiving a rotational driving force and transmitting the driving force to said shaft, wherein a rotational phase of said transmission member is uniquely determined relative to an abutment portion between said first projection and said first engaging portion.

11. An apparatus according to claim 10, further comprising:

a first driving portion for transmitting a driving force to said first engaging portion from said first projection;

a second driving portion for transmitting a driving force to said second engaging portion from said second projection;

a third driving portion for transmitting a driving force from said transmission member to said shaft and for determining a rotational phase of said shaft; and a fourth driving portion for transmitting a driving force which is smaller than the driving force at said third driving portion to said shaft.

12. An apparatus according to claim 11, wherein said third driving portion and said fourth driving portion are separated from each other by approximately 180 degrees with respect to a rotational direction of said rotation shaft.

13. An apparatus according to claim 10, wherein said transmission member is a first transmission member, and said apparatus further comprises:

a second transmission member, engageable with said first transmission member, for receiving a rotational driving force from a driving source and for transmitting the driving force to said first transmission member, wherein a rotational phase of said second transmission member relative to said first transmission member is determined uniquely.

14. An apparatus according to claim 13, further comprising:

a device for detecting a rotational phase of said second transmission member; and a control device for controlling a rotational phase of said second transmission member on the basis of a result of detection of said detecting device.

15. An image carrying unit comprising:

an image bearing member;

a shaft for rotating said image bearing member, wherein said shaft is provided with a first projection and a second projection, and said image bearing member is provided with a first engaging portion and a second engaging portion which are engageable with said first projection and said second projection, respectively, and wherein said first engaging portion is abuttable to said first projection at downstream and upstream sides of said first projection with respect to a rotational direction of said shaft, and said second engaging portion is abuttable to said second projection at a downstream side of said second projection with respect to a rotational direction of said shaft, and wherein a gap is provided between said second engaging portion and said second projection at an upstream side of said second projection with respect to a rotational direction of said shaft.

16. A unit according to claim 15, wherein said image bearing member includes a cylindrical portion and a supporting portion supporting said cylindrical portion, and wherein said first engaging portion and said second engaging portion are provided on said supporting portion.

17. A unit according to claim 15, wherein said first engaging portion is in the form of a round hole, and said second engaging portion is in the form of a rectangular hole.

18. A unit according to claim 15, wherein said first projection and said second projection include a pin.

19. A unit according to claim 18, wherein said pin penetrates said shaft, and one end of said pin constitutes said first projection, and the other end of said pin constitutes said second projection.

20. A unit according to claim 15, wherein a portion of said second engaging portion abuttable to said second projection is elastically deformable.

21. A unit according to claim 20, wherein a driving force applied by said shaft to said image bearing member at the abutting portion between said second projection and said second engaging portion is smaller than a driving force applied by said shaft to said image bearing member at the abutting portion between said first projection and said first engaging portion.

22. A unit according to claim 15, wherein a first driving portion for transmitting a driving force to said first engaging portion from said first projection and a second driving portion for transmitting a driving force to said second engaging portion from said second projection, are approximately 180 degrees apart from each other with respect to a rotational direction of said shaft.

23. A unit according to claim 15, further comprising:

a transmission member for receiving a rotational driving force and transmitting the driving force to said shaft, wherein a rotational phase of said transmission member is uniquely determined relative to an abutment portion between said first projection and said first engaging portion.

24. A unit according to claim 23, further comprising:

a first driving portion for transmitting a driving force to said first engaging portion from said first projection;

a second driving portion for transmitting a driving force to said second engaging portion from said second projection;

a third driving portion for transmitting a driving force from said transmission member to said shaft and for determining a rotational phase of said shaft; and a fourth driving portion for transmitting a driving force which is smaller than the driving force at said third driving portion to said shaft.

25. A unit according to claim 24, wherein said third driving portion and said fourth driving portion are separated from each other by approximately 180 degrees with respect to a rotational direction of said rotation shaft.

* * * * *

UNITED STATES PATENT AND TRADEMARK OFFICE

CERTIFICATE OF CORRECTION

PATENT NO. : 7,366,445 B2
APPLICATION NO. : 11/301253
DATED : April 29, 2008
INVENTOR(S) : Shigeru Hoashi et al.

It is certified that error appears in the above-identified patent and that said Letters Patent is hereby corrected as shown below:

COLUMN 1:
Line 26, “some”” should read --some of--.
Line 47, “image.” should read --image).--.
Line 50, “As” should read --as--.
Line 59, “relative” should read --relative to--.

COLUMN 2:
Line 2, “minimum” should read --minimize--.
Line 48, “form” should read --from--.
Line 50, “units.” should read --units).--.

COLUMN 4:
Line 10, “embodiment” should read --embodiments--.

COLUMN 5:
Line 12, “charge” should read --charging--.
Line 18, “and” should read --and 1*d*,-- and “which” should read --with--.
Line 21, “4*b*2, 4*b*2,” should read --4*b*2, 4*c*2--.
Line 62, “two-side” should read --two-sided--.
Line 67, “roller 8*d*.” should read --rollers 8*d*.--.

COLUMN 6:
Line 2, “described.” should read --described--.
Line 28, “flange” should read --flanges--.
Line 61, “5*b*, 5*d*,” should read --5*b*, 5*c*,--.

COLUMN 7:
Line 9, “an” should read --a--.
Line 41, “functions” should read --functions as--.

COLUMN 8:
Line 2, “generated” should read --generated by--.

COLUMN 9:
Line 21, “and 1*d*” should read --and 1*c*--.
Line 50, “133*c*” should read --133C--.

COLUMN 10:
Line 32, “105 a” should read --105*a*--.
Line 63, “Figure” should read --FIG. 4--.

UNITED STATES PATENT AND TRADEMARK OFFICE

CERTIFICATE OF CORRECTION

PATENT NO. : 7,366,445 B2
APPLICATION NO. : 11/301253
DATED : April 29, 2008
INVENTOR(S) : Shigeru Hoashi et al.

It is certified that error appears in the above-identified patent and that said Letters Patent is hereby corrected as shown below:

COLUMN 11:
Line 1, “in to” should read --into--.

COLUMN 12:
Line 1, “fits” should read --fit--.
Line 60, “the a” should read --the--.

COLUMN 13:
Line 18, “comes” should read --come--.

COLUMN 14:
Line 39, “occurs which” should read --occurs when--.

COLUMN 15:
Line 23, “four the” should read --the four--.

COLUMN 16:
Line 15, “point is” should read --point--.
Line 41, “ifluence” should read --influence--.
Line 43, “in” should read --In--.

COLUMN 17:
Line 12, “poing” should read --point--.

COLUMN 18:
Line 22, “drawing” should read --drawings--.
Line 38, “ping” should read --pin--.
Line 40, “though” should read --through--.
Line 46, “abovementioned the” should read --above-mentioned--.

UNITED STATES PATENT AND TRADEMARK OFFICE

CERTIFICATE OF CORRECTION

PATENT NO. : 7,366,445 B2
APPLICATION NO. : 11/301253
DATED : April 29, 2008
INVENTOR(S) : Shigeru Hoashi et al.

It is certified that error appears in the above-identified patent and that said Letters Patent is hereby corrected as shown below:

COLUMN 19:

Line 9, "spring" should read --springy--.

Signed and Sealed this

Thirtieth Day of September, 2008

JON W. DUDAS
*Director of the United States Patent and Trademark Office*